US011095038B2

(12) United States Patent
Kasahara et al.

(10) Patent No.: US 11,095,038 B2
(45) Date of Patent: Aug. 17, 2021

(54) POLARIZATION CONTROL PLATE

(71) Applicant: NEC Corporation, Tokyo (JP)

(72) Inventors: Yoshiaki Kasahara, Tokyo (JP); Eiji Hankui, Tokyo (JP); Hiroshi Toyao, Tokyo (JP); Keishi Kosaka, Tokyo (JP); Mingqi Wu, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 16/757,040

(22) PCT Filed: Oct. 23, 2017

(86) PCT No.: PCT/JP2017/038131
§ 371 (c)(1),
(2) Date: Apr. 17, 2020

(87) PCT Pub. No.: WO2019/082231
PCT Pub. Date: May 2, 2019

(65) Prior Publication Data
US 2020/0251827 A1 Aug. 6, 2020

(51) Int. Cl.
*H01Q 15/12* (2006.01)
*H01Q 15/00* (2006.01)

(52) U.S. Cl.
CPC ..... *H01Q 15/12* (2013.01); *H01Q 15/0026* (2013.01)

(58) Field of Classification Search
CPC ... H01Q 15/12; H01Q 15/0026; H01Q 15/244
See application file for complete search history.

(56) References Cited

U.S. PATENT DOCUMENTS 6,384,956 B1 * 5/2002 Shieh ..... G02F 1/0136 359/256
2002/0080079 A1 * 6/2002 McCandless ..... H01Q 15/244 343/772

(Continued)

FOREIGN PATENT DOCUMENTS

CN 103296476 A 9/2013
JP 2006-245917 A 9/2006

(Continued)

OTHER PUBLICATIONS

International Search Report for PCT Application No. PCT/JP2017/038131, dated Jan. 9, 2018.

(Continued)

*Primary Examiner* — Lam T Mai
(74) *Attorney, Agent, or Firm* — Sughrue Mion, PLLC

(57) ABSTRACT

The present invention provides a polarization control plate including n layers (n≥4) of overlapping admittance sheets (10-1 to 10-6) each of which includes a plurality of plane unit cells, in which an admittance of a first plane unit cell included in an admittance sheet in a layer a (1≤a≤n) and an admittance of a second plane unit cell being included in an admittance sheet in a layer b (1≤b≤n and b≠a) and overlapping the first plane unit cell are different from each other, and an admittance of the plane unit cell in an x direction and an admittance of the plane unit cell in a y direction are different from each other.

8 Claims, 22 Drawing Sheets

(56) References Cited

U.S. PATENT DOCUMENTS

| | | | | |
|---|---|---|---|---|
| 2004/0183616 | A1* | 9/2004 | McCandles | H01Q 15/246 333/21 A |
| 2005/0062661 | A1* | 3/2005 | Zagiiloul | H01Q 15/244 343/756 |
| 2008/0088781 | A1* | 4/2008 | Jung | G02F 1/1337 349/123 |
| 2010/0321607 | A1* | 12/2010 | Utsumi | G02F 1/133514 349/61 |
| 2011/0098033 | A1* | 4/2011 | Britz | H01Q 3/44 455/422.1 |
| 2012/0326800 | A1* | 12/2012 | Liu | H01Q 17/00 333/32 |
| 2013/0050058 | A1 | 2/2013 | Liu et al. | |
| 2014/0266977 | A1* | 9/2014 | Redd | H01Q 15/244 343/911 R |
| 2015/0138009 | A1 | 5/2015 | Liu et al. | |
| 2015/0303584 | A1 | 10/2015 | Liu et al. | |
| 2016/0011307 | A1 | 1/2016 | Casse et al. | |
| 2019/0058257 | A1* | 2/2019 | Song | H01Q 15/12 |
| 2019/0348578 | A1* | 11/2019 | Kuniyasu | B32B 27/306 |
| 2020/0259265 | A1* | 8/2020 | Kasahara | H01Q 15/02 |

FOREIGN PATENT DOCUMENTS

| | | | |
|---|---|---|---|
| JP | 2011-041100 | A | 2/2011 |
| JP | 2011-112942 | A | 6/2011 |
| JP | 2013-509097 | A | 3/2013 |
| JP | 2015-231184 | A | 12/2015 |
| JP | 2016-020899 | A | 2/2016 |
| WO | 2013/029326 | A1 | 3/2013 |

OTHER PUBLICATIONS

Ding et al., Metasurface for polarization and phase manipulation of the electromagnetic wave simultaneously, 2016 International Conference on Electromagnetics in Advanced Applications (ICEAA), IEEE, Sep. 19, 2016, pp. 393, 394, China.

Martini et al., Comparison of different numerical models for vvolumetric metamaterials, Antennas and Propagation (EUCAP), 2012 6th European Conference, IEEE, Mar. 26, 2012, pp. 2677-2679, Italy.

* cited by examiner

EQUIVALENT CIRCUIT DIAGRAM FOR SIX-LAYER STRUCTURE

EQUIVALENT CIRCUIT DIAGRAM FOR n-LAYER STRUCTURE

POLARIZATION CONTROL PLATE

This application is a National Stage Entry of PCT/JP2017/038131 filed on Oct. 23, 2017, the contents of all of which are incorporated herein by reference, in their entirety.

TECHNICAL FIELD

The present invention relates to a polarization control plate controlling polarization of an electromagnetic wave.

BACKGROUND ART

Technologies related to the present invention are disclosed in Patent Documents 1 and 2.

Patent Document 1 discloses adjustment of a polarization characteristic of a radiated wave with a structure in which a plurality of unit cells each of which includes two metal plates and a dielectric resonator positioned between the metal plates are arranged.

Patent Document 2 discloses a high-frequency substrate configured with a dielectric layer, a discontinuously divided conductor layer, including two or more conductor cells, a signal line, and an electric coupling element.

RELATED DOCUMENT

Patent Document

[Patent Document 1] Japanese Patent Application Publication No. 2011-41100

[Patent Document 2] Japanese Patent Application Publication No. 2006-245917

SUMMARY OF THE INVENTION

Technical Problem

The present inventors have discovered that an entire structure of a polarization control plate configured with an admittance sheet having a metal pattern approaches a resonance state at a predetermined amount of polarization rotation and causes inconveniences such as increase in a loss due to increase in flowing current. An object of the present invention is to reduce the inconveniences.

Solution to Problem

The present invention provides a polarization control plate including n layers ($n \geq 4$) of overlapping admittance sheets each of which includes a plurality of plane unit cells, in which an admittance of the plane unit cell in an x direction parallel with a plane in which the plane unit cell extends and an admittance of the plane unit cell in a y direction being orthogonal to the x direction and also being parallel with the plane are different from each other, and an admittance of a first plane unit cell included in an admittance sheet in a layer a ($1 \leq a \geq n$) and an admittance of a second plane unit cell being included in an admittance sheet in a layer b ($1 \leq b \leq n$ and $b \neq a$) and overlapping the first plane unit cell are different from each other.

Advantageous Effects of the Invention

The present invention can improve an inconvenience of an entire structure approaching a resonance state at a predetermined amount of polarization rotation and thus causing increase in a loss due to increase in flowing current.

BRIEF DESCRIPTION OF THE DRAWINGS

The aforementioned object, other objects, features and advantages will become more apparent by the following preferred example embodiments and accompanying drawings.

DESCRIPTION OF EMBODIMENTS

A polarization control plate according to the present example embodiment is configured with n layers ($n \geq 4$) of overlapping admittance sheets each of which includes a plurality of plane unit cells. A dielectric layer exists between two layers of admittance sheets. In other words, the polarization control plate has a structure including n layers of admittance sheets and (n−1) layers of dielectric layers, and the admittance sheets and the dielectric layers are alternately laminated.

Figure 1:
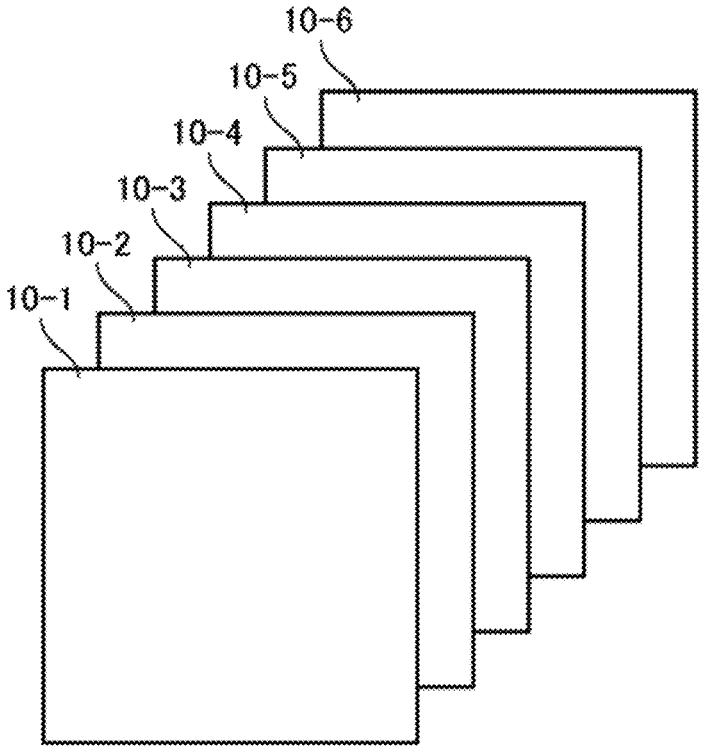
FIG. 1 is a diagram for illustrating an example of a structure of a polarization control plate according to the present example embodiment.

FIG. 1 discloses six layers of admittance sheets 10-1 to 10-6. For example, the polarization control plate according to the present example embodiment has a structure in which the six layers of admittance sheets 10-1 to 10-6 and five layers of dielectric layers are alternately laminated. Note that the polarization control plate according to the present example embodiment may have a structure in which five layers of admittance sheets and four layers of dielectric layers are alternately laminated, a structure in which four layers of admittance sheets and three layers of dielectric layers are alternately laminated, or another structure. Further, while the illustrated admittance sheet has a plane shape being a quadrangle, the plane shape may be another shape such as a circle.

Each admittance sheet has a metal pattern. A metal pattern has a structure in which a plurality of types of plane unit cells including metal are two-dimensionally arranged in accordance with a certain rule or randomly. Note that, for example, a dielectric exists in a part other than metal in an admittance sheet. A size of a plane unit cell is sufficiently small compared with a wavelength of an electromagnetic wave. Consequently, a set of plane unit cells functions as an electromagnetic continuous medium. By controlling a magnetic permeability and a dielectric constant with the metal pattern structure, a refractive index (phase velocity) and an impedance can be independently controlled. Further, by controlling a phase constant while matching a vacuum impedance value to an impedance value of the polarization control plate (in other words, keeping a reflection-free condition), an amount of phase shift being a delay in the polarization control plate can be controlled, and phases of electromagnetic waves incident on the polarization control plate can be aligned in the polarization control plate.

An example of a structure of the polarization control plate will be described.

Figure 2:
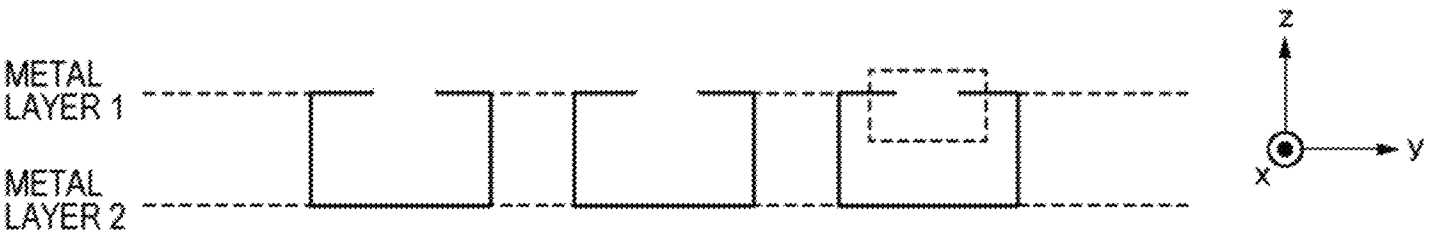
FIG. 2 is a diagram for illustrating an example of a structure for controlling a magnetic permeability.

First, referring to FIG. 2, an example of a structure for controlling a magnetic permeability will be described. FIG. 2 is a diagram illustrating a structure of a so-called split-ring resonator. The structure for controlling a magnetic permeability is configured with two metal layers. The metal layers extend in an xy-plane in the diagram. Then, a z direction in the diagram indicates a lamination direction of the two metal layers. A metal layer 1 corresponds to a first admittance sheet, and a metal layer 2 corresponds to a second admittance sheet. A linear or plate-shaped metal is formed in the metal layer 2. Two linear or plate-shaped metals separated from each other are formed in the metal layer 1. Then, the respective two metals in the metal layer 1 are connected to the same metal in the metal layer 2, for example, through vias. As illustrated, the metal in the metal layer 2, the two metals in the metal layer 1, and the two vias are connected to one another in such a way as to form a partially opened ring-shaped metal (split ring) when observed from an x direction. FIG. 2 illustrates a scene in which such split-ring structures are arranged in a y direction. The split-ring structures may be arranged in the x direction.

When a magnetic field Bin having a component in the x direction is applied to the structure, ring-shaped current Jind flows along a split ring. A split ring is described by a circuit model of a series LC resonator. An inductance L constituting the series LC resonator can be adjusted by adjusting a thickness, a width, and a length in a circumferential direction of the ring-shaped metal. Further, a capacitance C can be adjusted by adjusting a width of the opening part of a ring-shaped metal (a part enclosed by wavy lines in FIG. 2), a line width of the metal, and the like. The current Jind can be adjusted by adjustment of L and C. Then, by adjusting the current Jind, a magnetic field generated by the current can be adjusted. In other words, a magnetic permeability can be controlled. On the other hand, even when a magnetic field Bin having a component in the y direction is applied, current does not flow in a split ring, and a magnetic permeability is not controlled. In other words, control of a magnetic permeability is performed depending on a direction of a magnetic field, and therefore a magnetic permeability can be controlled so as to have polarization dependence. Therefore, the structure illustrated in FIG. 2 enables not only phase control but also polarization control.

Figure 3:
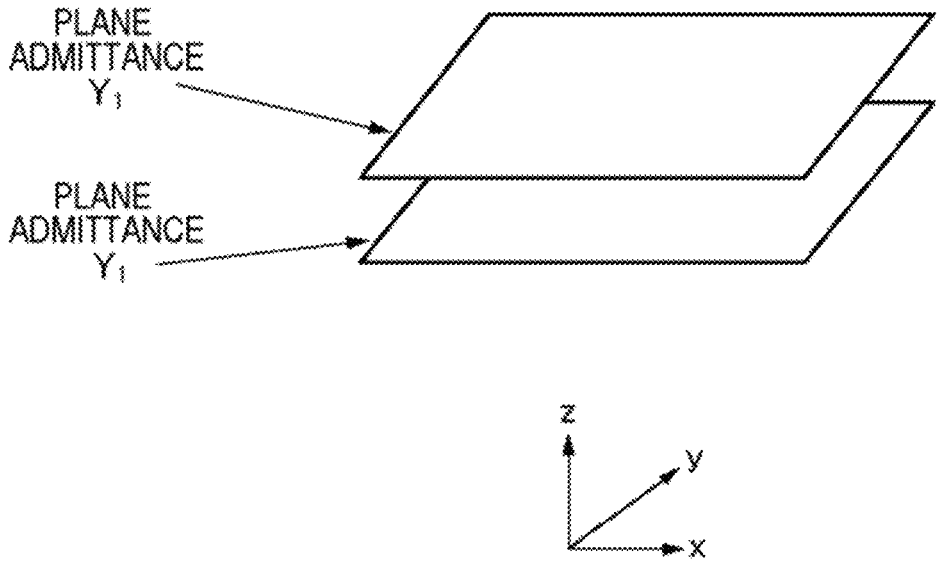
FIG. 3 is a diagram for illustrating an example of a structure for controlling a magnetic permeability.

Referring to FIG. 3, another example of a structure for controlling a magnetic permeability will be described. The structure for controlling a magnetic permeability is configured by arranging two metal pattern layers in such a way that the layers different from each other face each other. The two metal pattern layers extend in planes parallel with an xy-plane in the diagram. One metal pattern layer corresponds to a first admittance sheet, and the other metal pattern layer corresponds to a second admittance sheet. A metal pattern layer includes a metal pattern for controlling an impedance (admittance). When a magnetic field Bin having a component parallel with two metal pattern layers is applied between the two metal pattern layers, current Jind flows in the respective two metal pattern layers in directions opposite to each other. Currents induced by the magnetic field Bin always flow in directions opposed to each other and therefore can be equivalently considered as ring current and can induce a magnetic field. The current Jind can be adjusted by adjusting admittances of the two metal pattern layers. Then, by adjusting the current Jind, a magnetic field generated by the current can be adjusted. In other words, a magnetic permeability can be controlled. Adjustment of the admittances of the metal pattern layers can be achieved by adjusting an inductance L and a capacitance C formed by the metal patterns of the metal pattern layers.

Note that an admittance Y1 of the metal pattern layer has polarization dependence (direction dependence in a plane). For example, when a magnetic field Bin is applied in an x direction in FIG. 3, current flows on the metal pattern layer in a direction orthogonal to the magnetic field (a y direction), and a magnetic permeability is controlled. When a magnetic field Bin is applied in the y direction n FIG. 3, current flows on the metal pattern layer in a direction orthogonal to the magnetic field, that is, the x direction, and a magnetic permeability is controlled. By adjusting the metal pattern in such a way as to have different admittances for current flowing in the y direction and current flowing in the x direction, a magnetic permeability can be controlled so as to have polarization dependence. Having different admittances for current flowing in the y direction and current flowing in the x direction can be achieved by causing the metal pattern of the metal pattern layer to have different patterns for the x direction and the y direction. Therefore, two admittance-controlled metal pattern layers can be used as a structure for controlling a magnetic permeability, with direction dependence.

Figure 4:
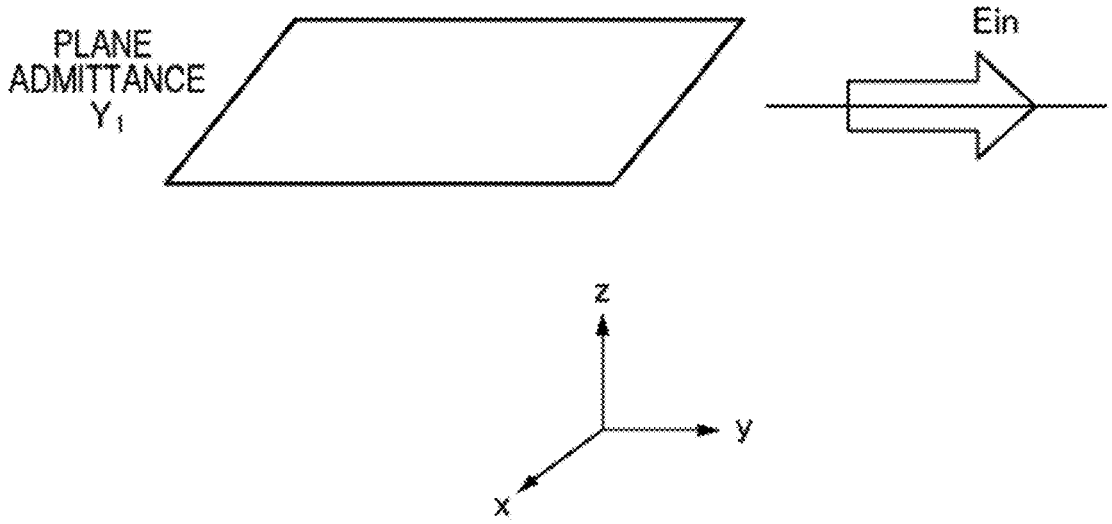
FIG. 4 is a diagram for illustrating an example of a structure for controlling a dielectric constant.

Next, referring to FIG. 4, an example of a structure for controlling a dielectric constant will be described. The structure for controlling a dielectric constant is configured with a single metal pattern layer. A metal pattern layer extends in an xy-plane in the diagram. The metal pattern layer corresponds to an admittance sheet. The metal pattern layer has a metal pattern for controlling an impedance (admittance). A potential difference is induced between two points in an admittance adjustment plane of the metal pattern layer by an electric field Ein in a direction as indicated in FIG. 4. By adjusting current Jind flowing due to the potential difference by adjusting the admittance of the metal pattern layer, an electric field generated by the current can be adjusted. In other words, a dielectric constant can be controlled.

Note that an admittance Y1 of the metal pattern layer has polarization dependence (direction dependence in a plane). For example, when an electric field Ein is applied in a y direction in FIG. 4, current flows on the metal pattern layer in a direction parallel with the electric field (the y direction) as described above, and a dielectric constant is controlled. When an electric field Ein is applied in an x direction in FIG. 4, current flows on the metal pattern layer in a direction parallel with the electric field, that is, the x direction, and a dielectric constant is controlled. By adjusting the metal pattern in such a way as to have different admittances for current flowing in the y direction and current flowing in the x direction, a dielectric constant can be controlled so as to have polarization dependence. Having different admittances for current flowing in the y direction and current flowing in the x direction can be achieved by causing the metal pattern of the metal pattern layer to have different patterns for the x direction and the y direction. Therefore, a single admittance-controlled metal pattern layer can be used as a structure for controlling a magnetic permeability, with direction dependence.

The above description tells that a magnetic permeability is controlled by two layers of metal pattern layers and a dielectric constant is controlled by a single-layer metal pattern layer. Further, the above description tells that a magnetic permeability and a dielectric constant can be controlled so as to have polarization dependence by causing a metal pattern of a metal pattern layer to have different patterns for an x direction and a y direction. An impedance and a phase constant are given by Equations (1) and (2) described below by use of a dielectric constant and a magnetic permeability. Therefore, an amount of phase shift being a delay in the polarization control plate can be controlled by controlling a phase constant while matching a vacuum impedance to an impedance of the polarization control plate (in other words, while keeping a reflection-free condition) by controlling the dielectric constant and the magnetic permeability. Additionally, as described above, the controlled dielectric constant (εeff) and magnetic permeability (μeff) may have different values depending on a direction of the metal pattern layer in a plane. Consequently, polarization can be controlled.

[Math. 1]

$$\eta eff = \sqrt{\frac{\mu eff}{\varepsilon eff}} \tag{1}$$

[Math. 2]

$$keff = \omega\sqrt{\varepsilon eff\,\mu eff} \tag{2}$$

Figure 5:
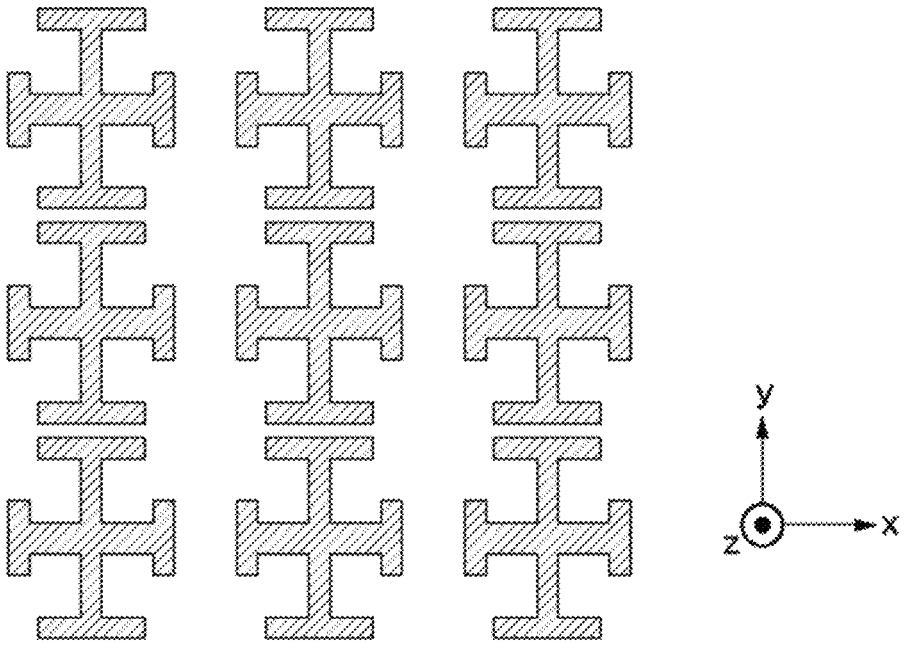
FIG. 5 is a diagram illustrating an example of a metal pattern of an admittance sheet.

Next, an example of a metal pattern for controlling an admittance, so as to have polarization dependence, will be described. In order to control an admittance over a wide range from a capacitance to an inductance, use of a resonance circuit is considered; and an example of a metal pattern providing a series resonance circuit is illustrated in FIG. 5. The illustrated metal pattern is a diagram illustrating a metal pattern in which a plurality of plane unit cells each of which forms a cross shape with a metal extending in an x-axis direction and a metal extending in a y-axis direction are arranged. Each of the metal extending in the x-axis direction and the metal extending in the y-axis direction forms an inductance L. Further, a line width of each of two ends of each of the metal extending in the x-axis direction and the metal extending in the y-axis direction is wider than that of the other part, and a capacitance C is formed between patterns adjoining in the x-axis direction and the y-axis direction. Consequently, series resonators in the x-axis direction and series resonators in the y-axis direction are formed.

Note that values of an inductance L and a capacitance C constituting a series resonator in the x-axis direction, and values of an inductance L and a capacitance C constituting a series resonator in the y-axis direction are different from each other in the pattern. Consequently, an admittance in the x-axis direction and an admittance in the y-axis direction are different from each other. In other words, an admittance of a plane unit cell according to the present example embodiment in the x direction parallel with a plane in which the plane unit cell extends (a plane parallel with the surface of the page in the case of FIG. 5) and an admittance of the plane unit cell in the y direction being orthogonal to the x direction and being parallel with the plane in which the plane unit cell extends are different from each other.

Figure 6:
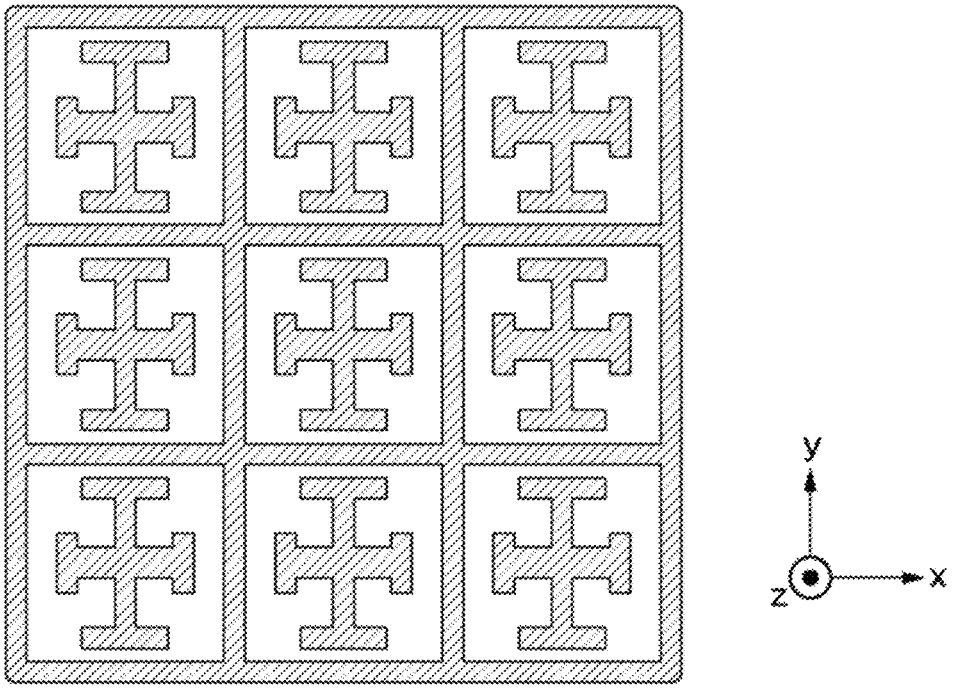
FIG. 6 is a diagram illustrating an example of a metal pattern of an admittance sheet.

Another example of a metal pattern controlling an admittance, so as to have polarization dependence, will be described. FIG. 6 illustrates an example of a metal pattern providing a parallel resonance circuit. FIG. 6 is a diagram illustrating a metal pattern in which a plurality of plane unit cells each of which encloses each of the cross-shaped structures illustrated in FIG. 5 with a ring-shaped metal having sides in the same directions as the x-axis and the y-axis are arranged. Each of the plurality of ring-shaped metals shares one side with an adjoining ring-shaped metal.

The metal pattern illustrated in FIG. 6 acts as a parallel resonance circuit with "an inductance L formed by a ring-shaped metal" and "a series resonator part in which a capacitance C formed by the ring-shaped metal adjoining a metal pattern inside the ring-shaped metal, an inductance L formed by the metal pattern inside the ring-shaped metal, and an capacitance C formed by the ring-shaped metal adjoining the metal pattern inside the ring-shaped metal are connected in series in this order." The series resonator part in which C, L, and C are connected in series operates as a capacitor up to a resonance frequency of the series resonator. Such parallel resonance circuits are formed in directions corresponding to the x-axis direction and the y-axis direction, respectively.

Note that values of an inductance L and a capacitance C constituting a parallel resonator in the x-axis direction, and values of an inductance L and a capacitance C constituting a parallel resonator in the y-axis direction are different from each other in the pattern. Consequently, an admittance in the x-axis direction and an admittance in the y-axis direction are different from each other. Therefore, the metal pattern can be used as a metal pattern for controlling an admittance, so as to have direction dependence.

When the difference in an amount of phase delay between the x-axis direction and the y-axis direction is 180 degrees, the metal pattern can be used as, for example, a polarization control plate converting radial linearly polarized waves before incidence into linearly polarized waves aligned in one direction. Further, when the difference in an amount of phase delay between the x-axis direction and the y-axis direction is 90 degrees, the metal pattern can be used as, for example, a polarization control plate converting radial linearly polarized waves before incidence into circularly polarized waves.

Figure 7:
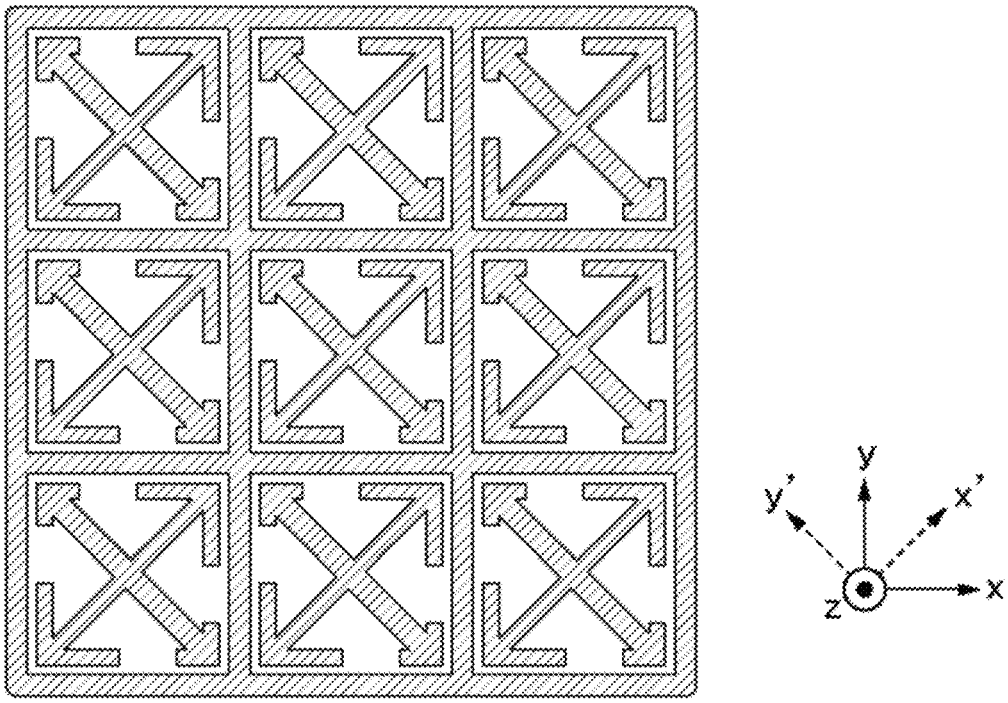
FIG. 7 is a diagram illustrating an example of a metal pattern of an admittance sheet.

Another example of a metal pattern for controlling an admittance, so as to have polarization dependence, will be described. FIG. 7 illustrates an example of a metal pattern providing a parallel resonance circuit. The metal pattern in FIG. 7 differs from the metal pattern in FIG. 6 in that a direction of a cross-shaped metal positioned inside a ring-shaped metal is different. The other configuration is similar.

While two lines of a cross-shaped metal in FIG. 6 extend in the x-axis direction and the y-axis direction, respectively, two lines of a cross-shaped metal in FIG. 7 extend in an x'-axis direction and a y'-axis direction, respectively. The x'-axis direction and the y'-axis direction are directions acquired by rotating the x-axis direction and the y-axis direction around the z-axis by 45 degrees, respectively. Consequently, while parallel resonance circuits in FIG. 6 are formed in directions corresponding to the x-axis direction and the y-axis direction, respectively, parallel resonance circuits in FIG. 7 are formed in directions corresponding to the x'-axis direction and the y'-axis direction, respectively. Therefore, the metal pattern can be used as a metal pattern generating different amounts of phase delay in the x'-axis direction and the y'-axis direction.

When the difference in an amount of phase delay between the x'-axis direction and the y'-axis direction is 180 degrees, the metal pattern can be used as, for example, a polarization control plate converting radial linearly polarized waves before incidence into linearly polarized waves aligned in one direction. When the difference in an amount of phase delay between the x'-axis direction and the y'-axis direction is 90 degrees, the metal pattern can be used as, for example, a polarization control plate converting radial linearly polarized waves before incidence into circularly polarized waves.

Figure 8:
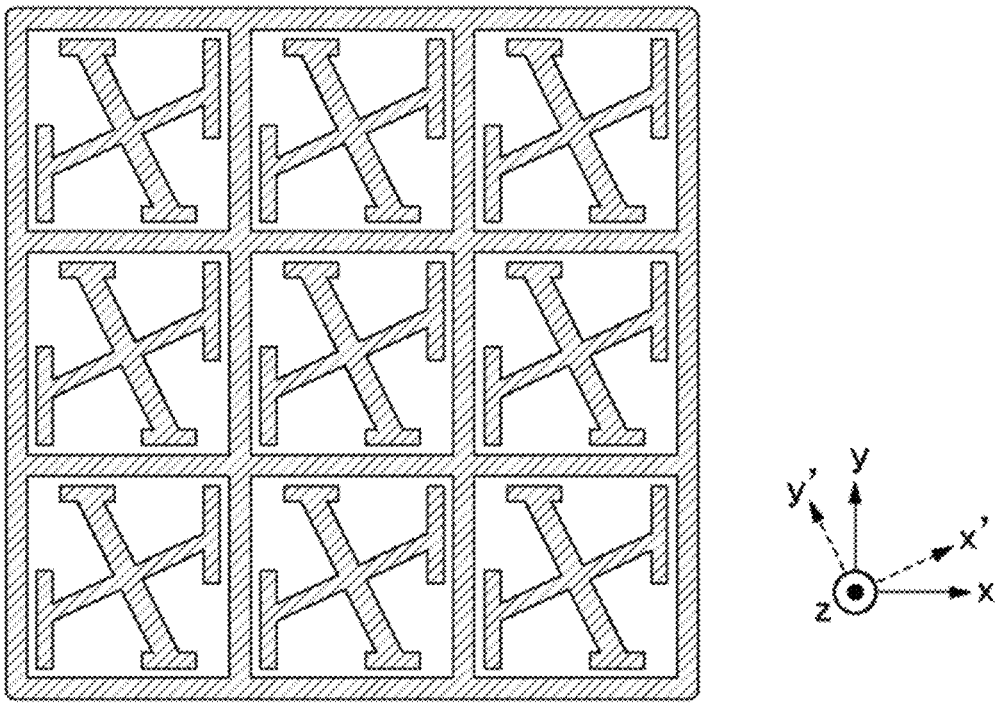
FIG. 8 is a diagram illustrating an example of a metal pattern of an admittance sheet.

Another example of a metal pattern for controlling an admittance, so as to have polarization dependence, will be described. FIG. 8 illustrates an example of a metal pattern providing a parallel resonance circuit. The metal pattern in FIG. 8 differs from the metal pattern in FIG. 6 in that a direction of a cross-shaped metal positioned inside a ring-shaped metal is different. The other configuration is similar.

While two lines of a cross-shaped metal in FIG. 6 extend in the x-axis direction and the y-axis direction, respectively, two lines of a cross-shaped metal in FIG. 8 extend in an x'-axis direction and a y'-axis direction, respectively. The x'-axis direction and the y'-axis direction are directions acquired by rotating the x-axis direction and the y-axis direction around the z-axis by 22.5 degrees, respectively. Consequently, while parallel resonance circuits in FIG. 6 are formed in directions corresponding to the x-axis direction and the y-axis direction, respectively, parallel resonance circuits in FIG. 8 are formed in directions corresponding to the x'-axis direction and the y'-axis direction, respectively. Therefore, the metal pattern can be used as a metal pattern generating different amounts of phase delay in the x'-axis direction and the y'-axis direction.

When the difference in an amount of phase delay between the x'-axis direction and the y'-axis direction is 180 degrees, the metal pattern can be used as, for example, a polarization control plate converting radial linearly polarized waves before incidence into linearly polarized waves aligned in one direction. When the difference in an amount of phase delay between the x'-axis direction and the y'-axis direction is 90 degrees, the metal pattern can be used as, for example, a polarization control plate converting radial linearly polarized waves before incidence into circularly polarized waves.

Note that, while each of the metal patterns illustrated in FIG. 5 to FIG. 8 is configured by arranging a plurality of plane unit cells with the same shape, a plurality of types of plane unit cells different from one another in terms of a length of a metal line, a thickness of a metal line, an interval between metal lines, an area of a metal part, and the like may be arranged.

Figure 9:
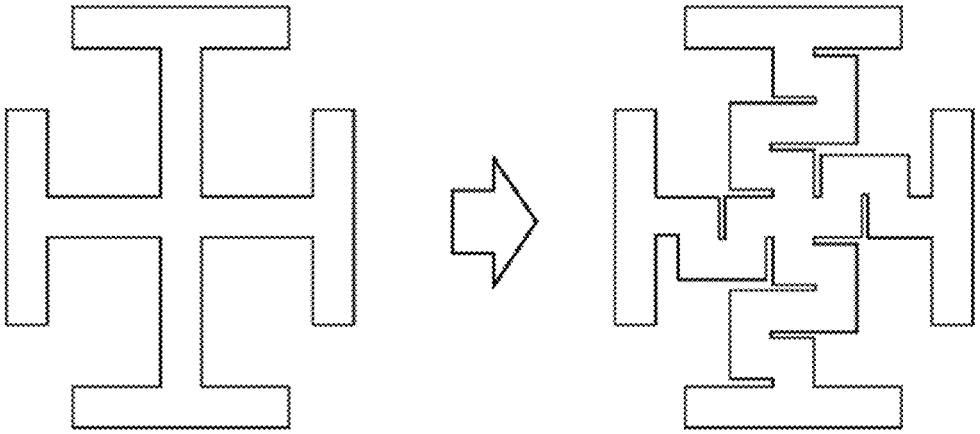
FIG. 9 is a diagram illustrating an example of a metal pattern of an admittance sheet.
Figure 10:
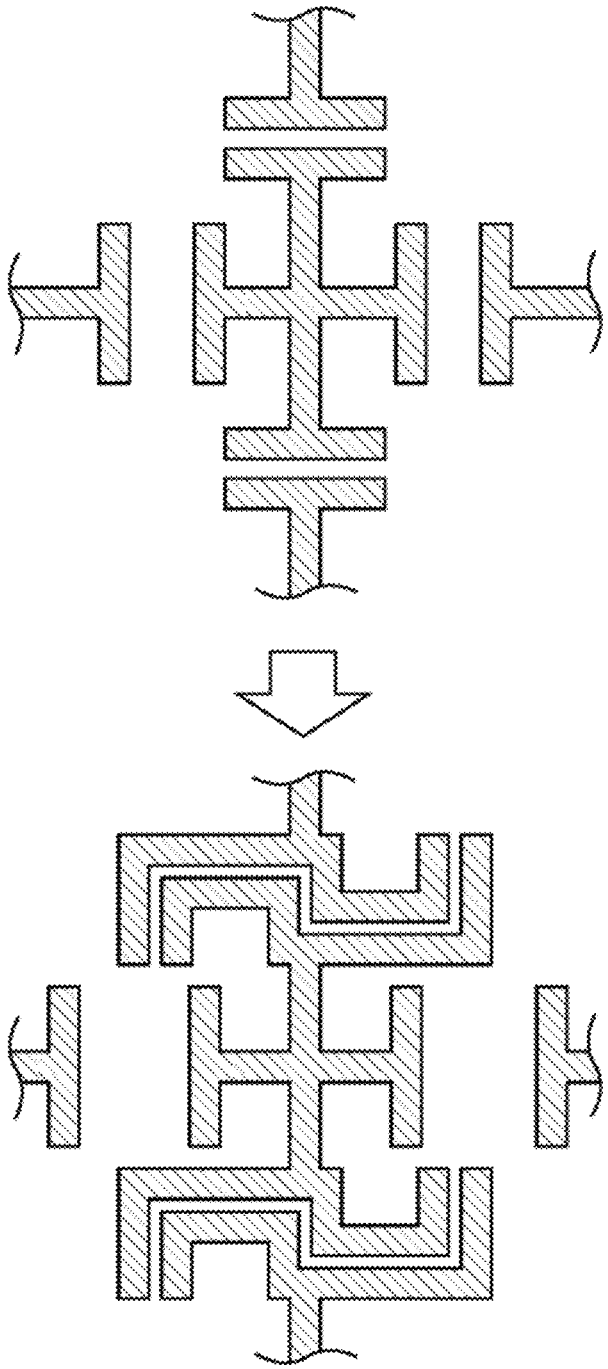
FIG. 10 is a diagram illustrating an example of a metal pattern of an admittance sheet.

When designing a metal pattern, C can be increased by forming a capacitor part as, for example, an interdigital capacitor. Further, L can be increased by forming an inductor part as, for example, a meander inductor or a spiral inductor. FIG. 9 and FIG. 10 illustrate examples. In FIG. 9, an effect of increasing L can be expected by changing a linear metal pattern to a meander shape. In FIG. 10, an effect of increasing C can be expected by changing opposing metal patterns to interdigital shapes.

Next, an example of a lamination method of an admittance sheet having the metal pattern as described above will be described. The polarization control plate according to the present example embodiment is configured by overlapping n layers ($n \geq 4$) of admittance sheets each of which has the aforementioned metal pattern.

Figure 11:
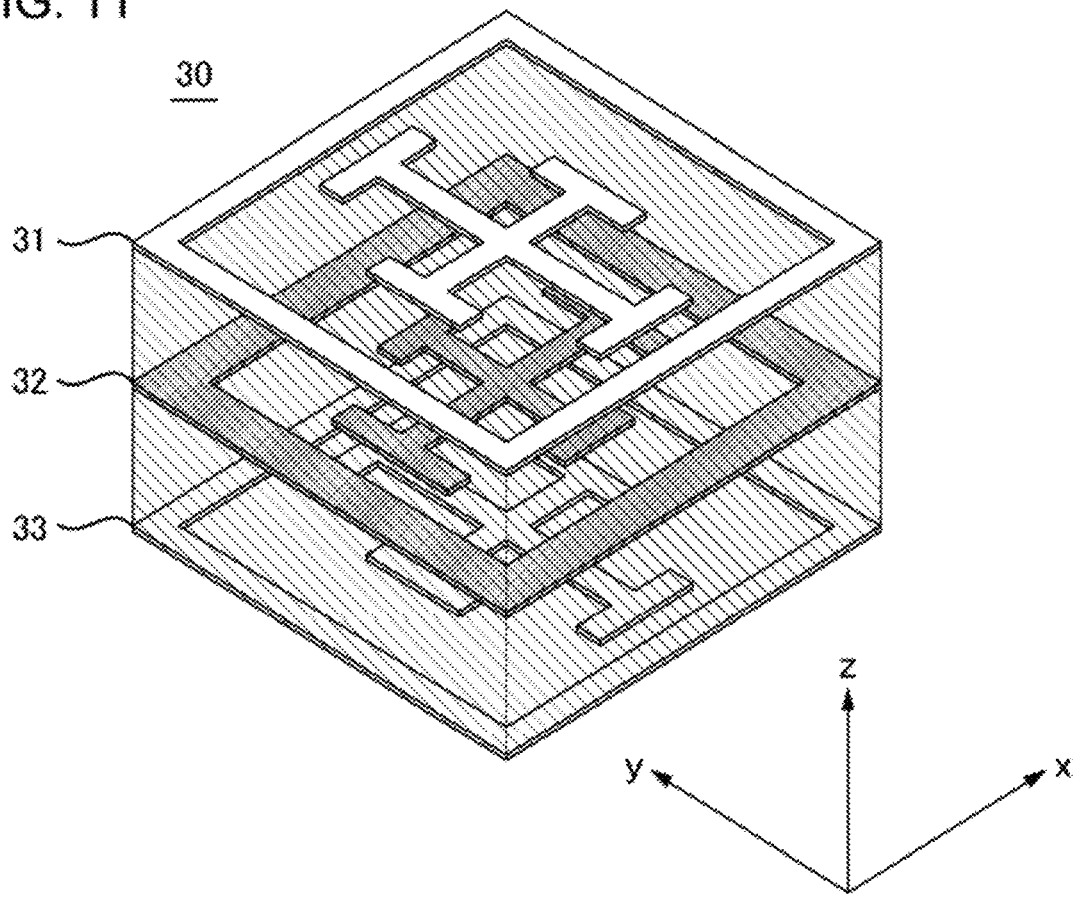
FIG. 11 is a diagram for illustrating an example of a laminated body in which plane unit cells are laminated.

FIG. 11 is an example of laminating three layers of admittance sheets and illustrates a laminated body 30 in which plane unit cells 31 to 33 in the respective layers are laminated. According to the present example embodiment, for example, by repeatedly laminating three layers of admittance sheets as illustrated, a polarization control plate including six layers or more of admittance sheets can be provided. As illustrated, a plurality of admittance sheets are laminated in such a way that the plane unit cells 31 to 33 overlap one another. It is preferable that the plane unit cells 31 to 33 of the respective admittance sheets completely overlap one another as illustrated, but a discrepancy may occur.

FIG. 11 illustrates an example of the parallel resonator type laminated body 30. The laminated body 30 is configured with the first plane unit cell 31, the second plane unit cell 32, and the third plane unit cell. Each of the first plane unit cell 31 to third plane unit cell 33 includes an outer peripheral metal enclosing an outer periphery and a cross-shaped inner metal positioned inside the outer peripheral metal. A line width at each end of two linear metals forming the cross shape is widened. Further, the outer peripheral metal is isolated from the inner metal. A linear metal extending in a y-axis direction is longer than a linear metal extending in an x-axis direction in the cross-shaped inner metals in the first plane unit cell 31 and the third plane unit cell 33. On the other hand, a linear metal extending in the x-axis direction is longer than a linear metal extending in the y-axis direction in the cross-shaped inner metal in the second plane unit cell 32. Further, the outer peripheral metal in the second plane unit cell 32 is wider than the outer peripheral metals in the first plane unit cell 31 and the third plane unit cell 33. The first plane unit cell 31 to the third plane unit cell 33 are isolated from one another. A part where a metal pattern does not exist is filled with, for example, a dielectric.

Note that n layers ($n \geq 4$) of admittance sheets are laminated in such a way as to satisfy the following conditions, First, an admittance of a first plane unit cell included in an admittance sheet in a layer a ($1 \leq a \leq n$) out of then layers ($n \geq 4$) of admittance sheets and an admittance of a second plane unit cell being included in an admittance sheet in a layer b ($1 \leq b \leq n$ and $b \neq a$) and overlapping the first plane unit cell are different from each other. In other words, plane unit cells admittances of which are different from each other exist in a three-dimensional unit cell configured with a plurality of plane unit cells overlapping one another.

Further, the polarization control plate according to the present example embodiment includes a plurality of three-dimensional unit cells each of which is configured with a plurality of plane unit cells overlapping one another. A three-dimensional unit cell is configured by laminating n layers (n≥4) of plane unit cells. Then, a condition "when admittances of a plurality of plane unit cells included in the same three-dimensional unit cell are compared, the difference between an admittance of a c-th layer (1≤c≤n) and an admittance of an (n−c+1)-th layer is less than a reference value" is satisfied in at least one of the plurality of three-dimensional unit cells included in the polarization control plate. In other words, admittances of a plurality of plane unit cells included in the same three-dimensional unit cell are symmetric with respect to the plane unit cell in the middle.

In this case, a metal pattern of a plane unit cell in the c-th layer (1≤c≤n) may be the same as a metal pattern of a plane unit cell in the (n−c+1)-th layer in at least one three-dimensional unit cell. The same metal pattern means that shapes, line widths, line lengths, and the like of metals are equivalent and the difference in admittance is less than the reference value.

Such a symmetric structure can simplify design.

Figure 12:
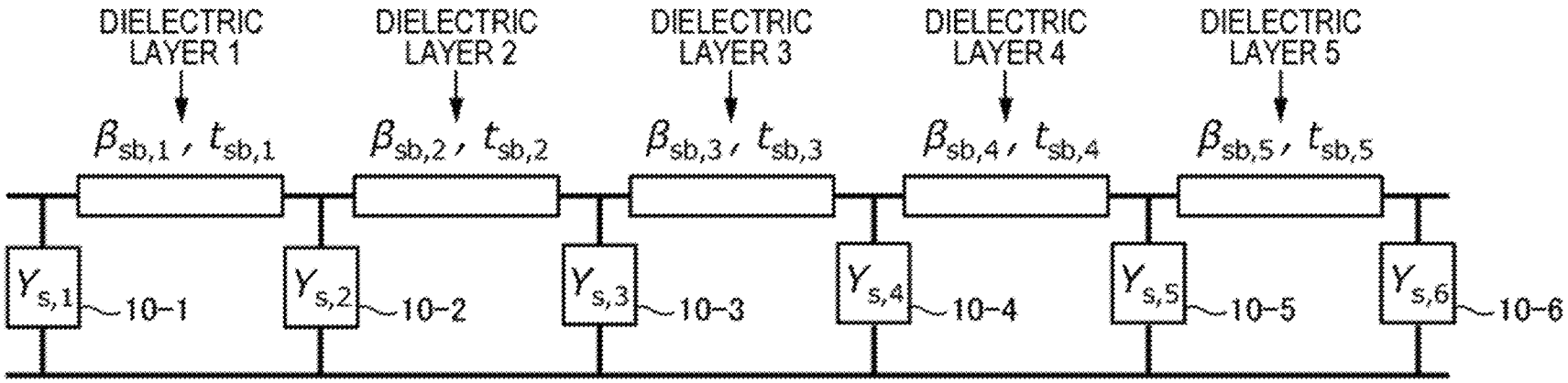
FIG. 12 is a diagram illustrating an example of an equivalent circuit diagram of a polarization control plate.
Figure 13:
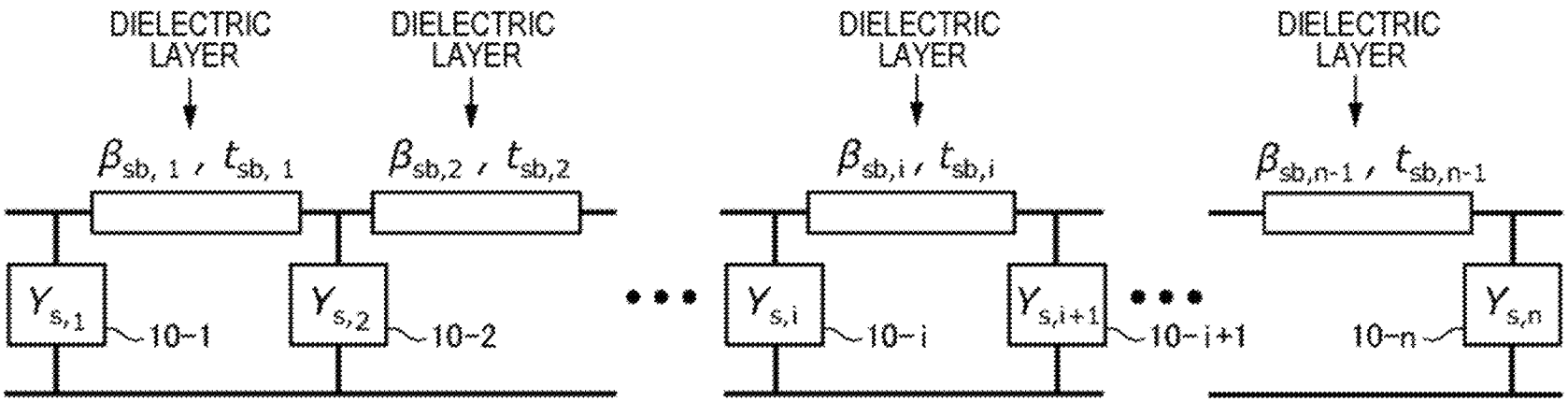
FIG. 13 is a diagram illustrating an example of an equivalent circuit diagram of a polarization control plate.

Further, an equivalent circuit diagram of a polarization control plate in which six layers of admittance sheets and five layers of dielectric layers are laminated is illustrated in FIG. 12. Note that an equivalent circuit diagram of a polarization control plate in which n layers of admittance sheets and (n−1) layers of dielectric layers are laminated is illustrated in FIG. 13.

Y denotes an admittance, β denotes a phase constant in a dielectric layer, and t denotes a thickness of the dielectric layer. An ABCD matrix of each admittance sheet and each dielectric layer can be written down from the equivalent circuit diagram, and a Z matrix ($Z_{11}$, $Z_{12}$, $Z_{21}$, $Z_{22}$) of the polarization control plate can also be written down from the ABCD matrices.

A scattering coefficient formula G expressed by Equation (3) is described by use of the Z matrix and normalized impedances ($Z_S$, $Z_L$) of the polarization control plate.

[Math. 3]

SCATTERING COEFFICIENT FORMULA $$G = \begin{pmatrix} \frac{1}{\sqrt{Z_s}} & 0 \\ 0 & \frac{1}{\sqrt{Z_L}} \end{pmatrix} \left[\begin{pmatrix} Z_{11} & Z_{12} \\ Z_{21} & Z_{22} \end{pmatrix} + \begin{pmatrix} Z_S & 0 \\ 0 & Z_L \end{pmatrix}\right]\left[\begin{pmatrix} Z_{11} & Z_{12} \\ Z_{21} & Z_{22} \end{pmatrix} - \begin{pmatrix} Z_S & 0 \\ 0 & Z_L \end{pmatrix}\right]^{-1} \begin{pmatrix} \frac{1}{\sqrt{Z_s}} & 0 \\ 0 & \frac{1}{\sqrt{Z_L}} \end{pmatrix}^{-1} \tag{3}$$

$Z_S$ denotes a normalized impedance determined by an incidence angle of an electromagnetic wave with respect to the polarization control plate and a space impedance of a space where the polarization control plate is positioned (for example, an impedance of air). $Z_L$ denotes a normalized impedance determined by an emission angle of an electromagnetic wave with respect to the polarization control plate and the aforementioned space impedance.

When an incident wave and an emitted wave are transverse electric (TE) waves, $Z_S$ and $Z_L$ are expressed as Equations (4) and (5).

[Math. 4]

$$Z_s = \eta_0 \frac{1}{\cos_{\theta_i}} \tag{4}$$

[Math. 5]

$$Z_L = \eta_0 \frac{1}{\cos_{\theta_t}} \tag{5}$$

Further, when an incident wave and an emitted wave are transverse magnetic (TM) waves, $Z_S$ and $Z_L$ are expressed as Equations (6) and (7).

[Math. 6]

$$Z_S = \eta_0 \cos_{\theta i} \tag{6}$$

[Math. 7]

$$Z_L = \eta_0 \cos \theta_t \tag{7}$$

Note that $\eta_0$ is a space impedance of a space where the polarization control plate is positioned. Further, $\theta_i$ is an incidence angle of an electromagnetic wave with respect to the polarization control plate. Further, $\theta_t$ is an emission angle of an electromagnetic wave with respect to the polarization control plate.

According to the present example embodiment, admittances of n layers of admittance sheets are given in such a way that an off-diagonal element of the aforementioned scattering coefficient formula G is equal to or greater than 0.8. A structure satisfying the condition provides a high dielectric constant.

Next, an arrangement of a plurality of three-dimensional unit cells in a plane direction, each of the three-dimensional unit cells being configured with a plurality of plane unit cells overlapping one another, will be described. By optimizing the arrangement, desired polarization control of an electromagnetic wave is achieved.

Figure 14:
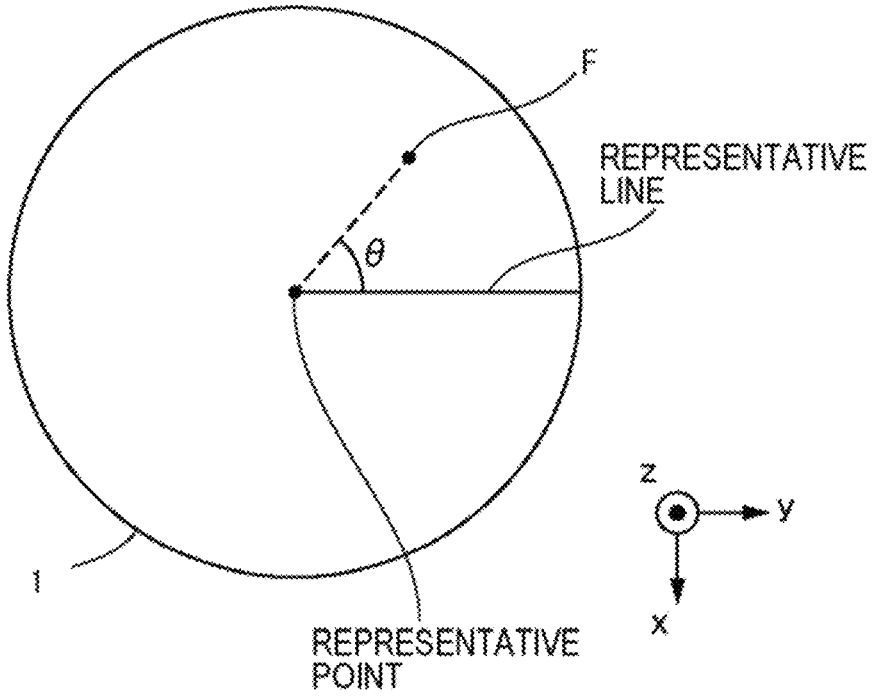
FIG. 14 is a diagram for illustrating an example of an arrangement of three-dimensional unit cells.

First, as illustrated in FIG. 14, an arbitrary line drawn from a representative point on a polarization control plate 1 toward an edge of the polarization control plate 1 is defined as a representative line. A plurality of three-dimensional unit cells (a three-dimensional unit cell group) giving the same polarization state change to a transmitting electromagnetic wave are linearly arranged on the polarization control plate 1 from the representative point toward the edge of the polarization control plate 1. Then, straight lines of a plurality of three-dimensional unit cell groups giving polarization state changes different from one another are radially arranged from the representative point toward edges of the polarization control plate 1. Note that a transmitting polarization state at a point F (reference point) on the polarization control plate 1 varies according to an angle (angle θ in FIG. 14) formed between the representative line and a line (reference line) connecting the point F (reference point) to the representative point. In other words, a polarization state at each point is determined according to an angle formed between the representative line passing through the point and a reference line. Note that it is desirable that the representative point be near the center of the surface of the polarization control plate 1.

For example, the polarization control plate 1 can be provided by arranging, in a predetermined order from a representative point on the polarization control plate 1, three-dimensional unit cells giving different polarization state changes in the polarization control plate 1 plane. The difference in an amount of phase delay between two orthogonal polarization components has only to be controlled in order to control polarization of an electromagnetic wave.

For example, the polarization control plate 1 may be configured by arranging, on a line from a representative point toward an edge of the polarization control plate 1, three-dimensional unit cells giving a predetermined phase delay defined according to an angle θ (rotation angle) formed between the line and a representative line.

Figure 15:
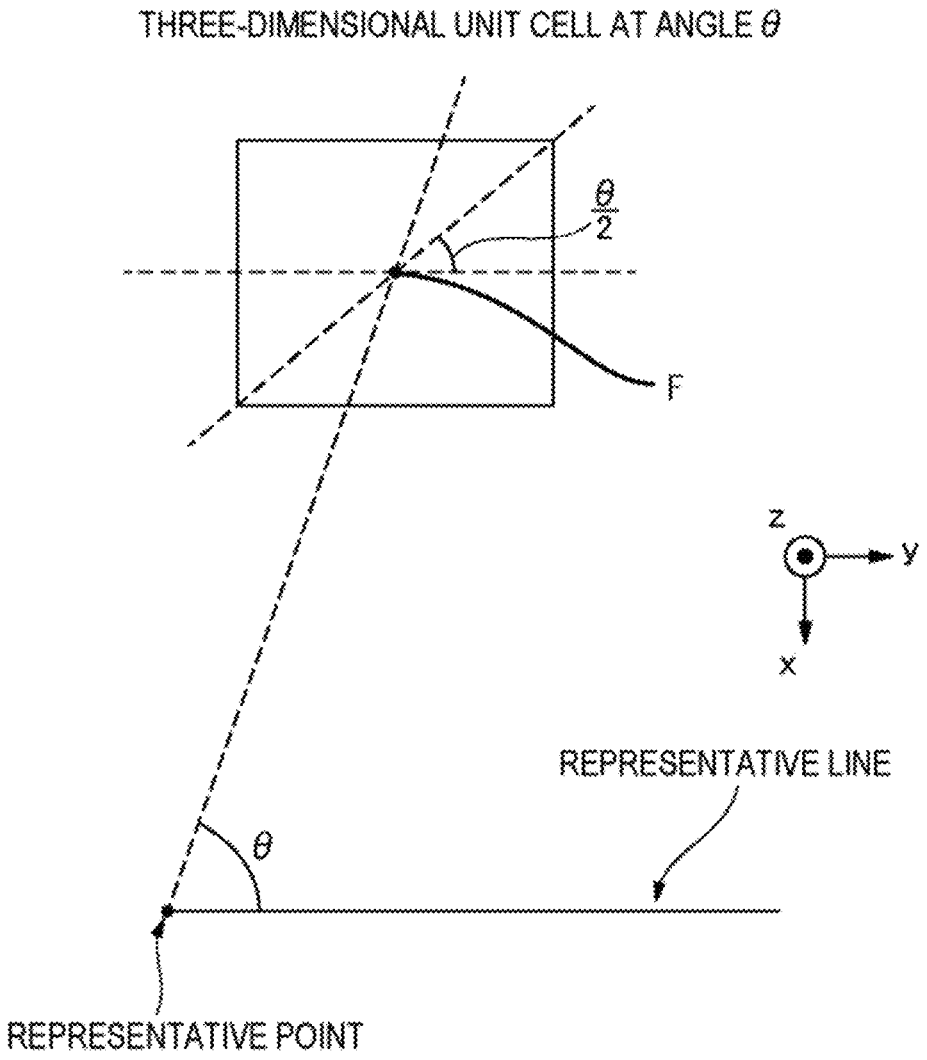
FIG. 15 is a diagram for illustrating an example of an arrangement of three-dimensional unit cells.

Specifically, when converting a radial polarization state into a linear polarization state aligned in one direction, three-dimensional unit cells having a characteristic of an amount of phase delay given in a direction of an angle π/2 being different by 180 degrees (π/2) from an amount of phase delay given in a direction of an angle (θ/2+90) degrees may be arranged on a line forming an angle θ with the representative line, as illustrated in FIG. 15. An amount of phase delay refers to the phase difference between an incidence plane and an emission plane of the polarization control plate 1.

Further, when converting a radial polarization state into an identical circular polarization, three-dimensional unit cells having a characteristic of an amount of phase delay given in a direction of an angle (θ+45) degrees being different by 90 degrees (π/4) or −90 degrees (−π/4) from an amount of phase delay given in a direction of an angle (θ+135) degrees may be arranged on a line forming an angle θ with the representative line. The function is achieved by arranging a plurality of types of three-dimensional unit cells with performance different from one another in a predetermined order. The above will be described below.

Figure 16:
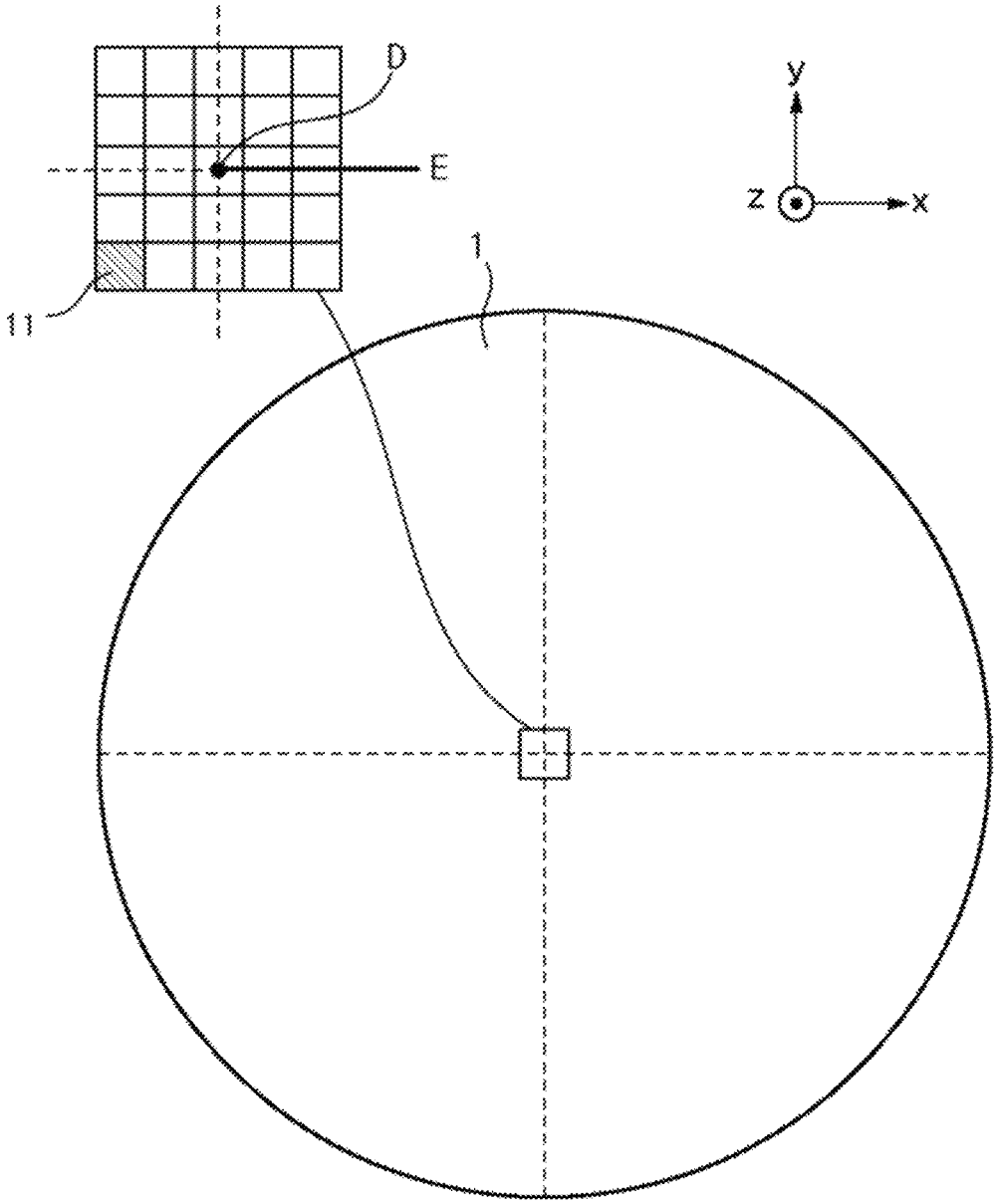
FIG. 16 is a diagram for illustrating an example of an arrangement of three-dimensional unit cells.

For example, a reference point (for example, the center of a three-dimensional unit cell 11) is defined for each of a plurality of three-dimensional unit cells 11 arranged as illustrated in FIG. 16, and an angle θ formed between a straight line (reference line) connecting the reference point to a representative point D and a representative line E of the polarization control plate 1 is computed for each three-dimensional unit cell 11. For example, the angle θ refers to an angle measured from the reference line in a counterclockwise direction out of angles formed between the reference line and the representative line E. Then, a plurality of three-dimensional unit cells are grouped according to a value of 0. For example, three-dimensional unit cells 11 satisfying each of a plurality of numerical conditions such as m0≤θ≤m1, m1≤θ≤m2, m2≤θ≤m3, . . . may belong to the same group. Then, a plurality of three-dimensional unit cells 11 in the same group have the same configuration and characteristic (polarization state change). Consequently, the aforementioned radial arrangement can be achieved. Note that "the same polarization state change" is a concept including a complete match and an error (for example, variation in an amount of polarization state control caused by a processing error or an etching error).

Note that a direction of a fast axis (an axis giving a smaller amount of phase delay out of two orthogonal axes giving different phase delays in a three-dimensional unit cell) of a three-dimensional unit cell in the polarization control plate 1 can be determined according to a value of θ such as m0≤θ≤m1, m1<θ≤m2, m2<θ≤m3, . . . . At this time, when a polarization state after passage through the polarization control plate 1 is aligned to linear polarization, the direction of the fast axis is set to θ/2 with respect to θ. At this time, a direction of a slow axis (an axis giving a larger amount of phase delay out of two orthogonal axes giving different phase delays in a three-dimensional unit cell) is (θ/2+90) degrees, and the difference in an amount of phase delay between the fast axis and the slow axis is 180 degrees. When a polarization state after passage through the polarization control plate 1 is aligned to circular polarization, the direction of the fast axis is set to (θ+45) degrees with respect to θ. At this time, the direction of the slow axis is (θ+135) degrees, and the difference in an amount of phase delay between the fast axis and the slow axis is 90 degrees. While it is desirable that the aforementioned two axes are orthogonal to each other, the axes do not necessarily need to be orthogonal to each other; and the concept described above includes a certain degree of error. For example, an angle formed between the fast axis and the slow axis has only to be within 90 degrees ±45 degrees and more desirably within 90 degrees ±30 degrees or 90 degrees ±15 degrees.

Advantageous effects of the polarization control plate according to the present example embodiment will be described. The entire structure of the polarization control plate configured by laminating a plurality of admittance sheets approaches a resonance state when a predetermined condition is satisfied. Consequently, inconveniences such as a narrowed bandwidth in addition to increase in flowing current and increase in a loss occur. The present inventors have discovered that when a structure including three layers of admittance sheets and two layers of dielectric layers that are alternately laminated is configured to perform polarization rotation control (phase delay control) over a wide range from 0 to 360 degrees, the aforementioned resonance state is likely to occur at a specific amount of polarization rotation.

The polarization control plate according to the present example embodiment resolves the problem with a structure including six layers of admittance sheets and five layers of dielectric layers that are alternately laminated. Three layers of admittance sheets and two layers of dielectric layers in the laminated structure perform polarization rotation control for 0 to 180 degrees, and the other three layers of admittance sheets and the other two layers of dielectric layers perform polarization rotation control for 180 to 360 degrees. The inconvenience being occurrence of a resonance state is avoided by narrowing a range covered by the structure including three layers of admittance sheets and two layers of dielectric layers. Then, polarization rotation control over a wide range from 0 to 360 degrees is achieved by laminating structures each of which includes three layers of admittance sheets and two layers of dielectric layers.

Figure 17:
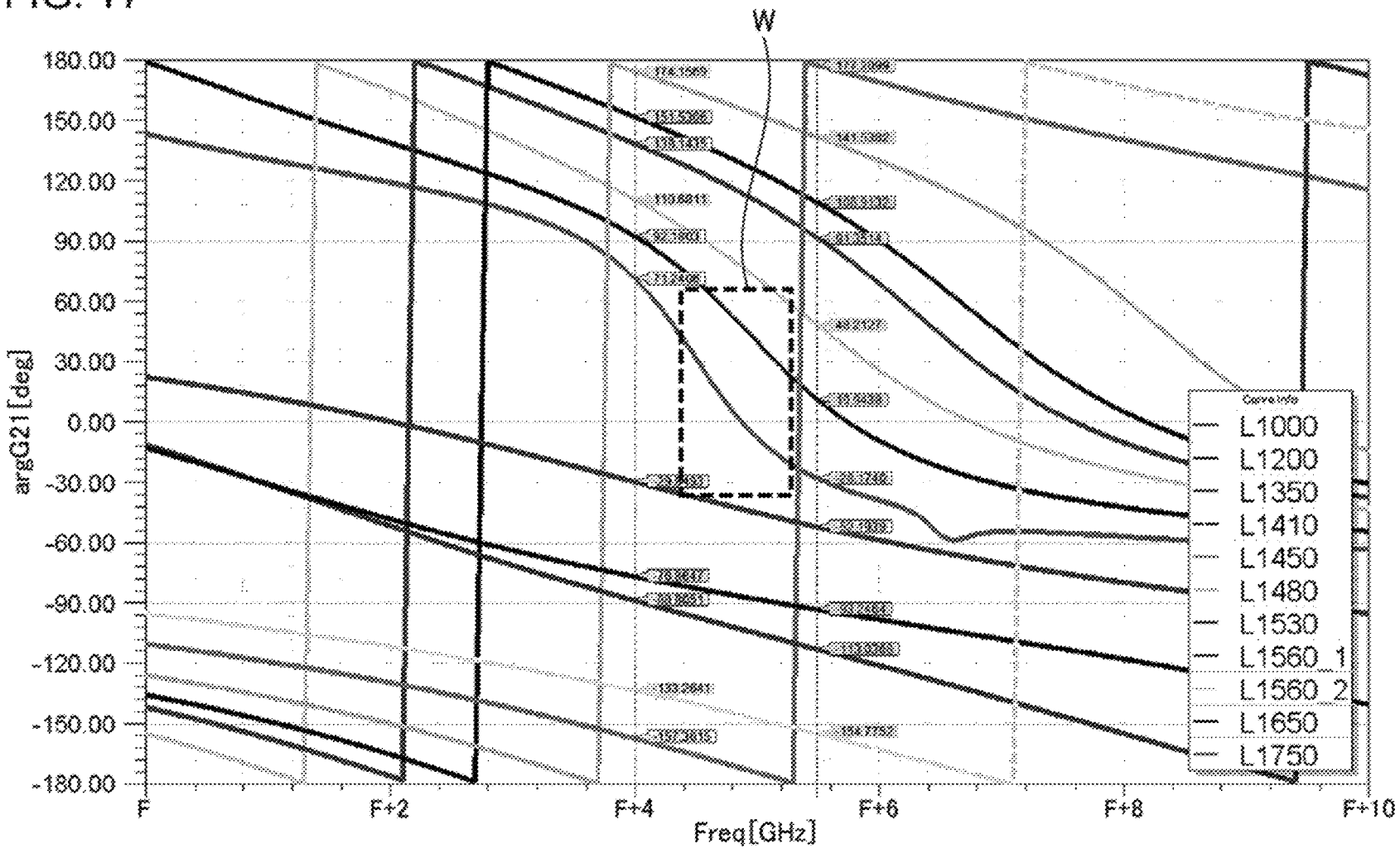
FIG. 17 is a diagram illustrating a simulation result of a three-layer structure.
Figure 18:
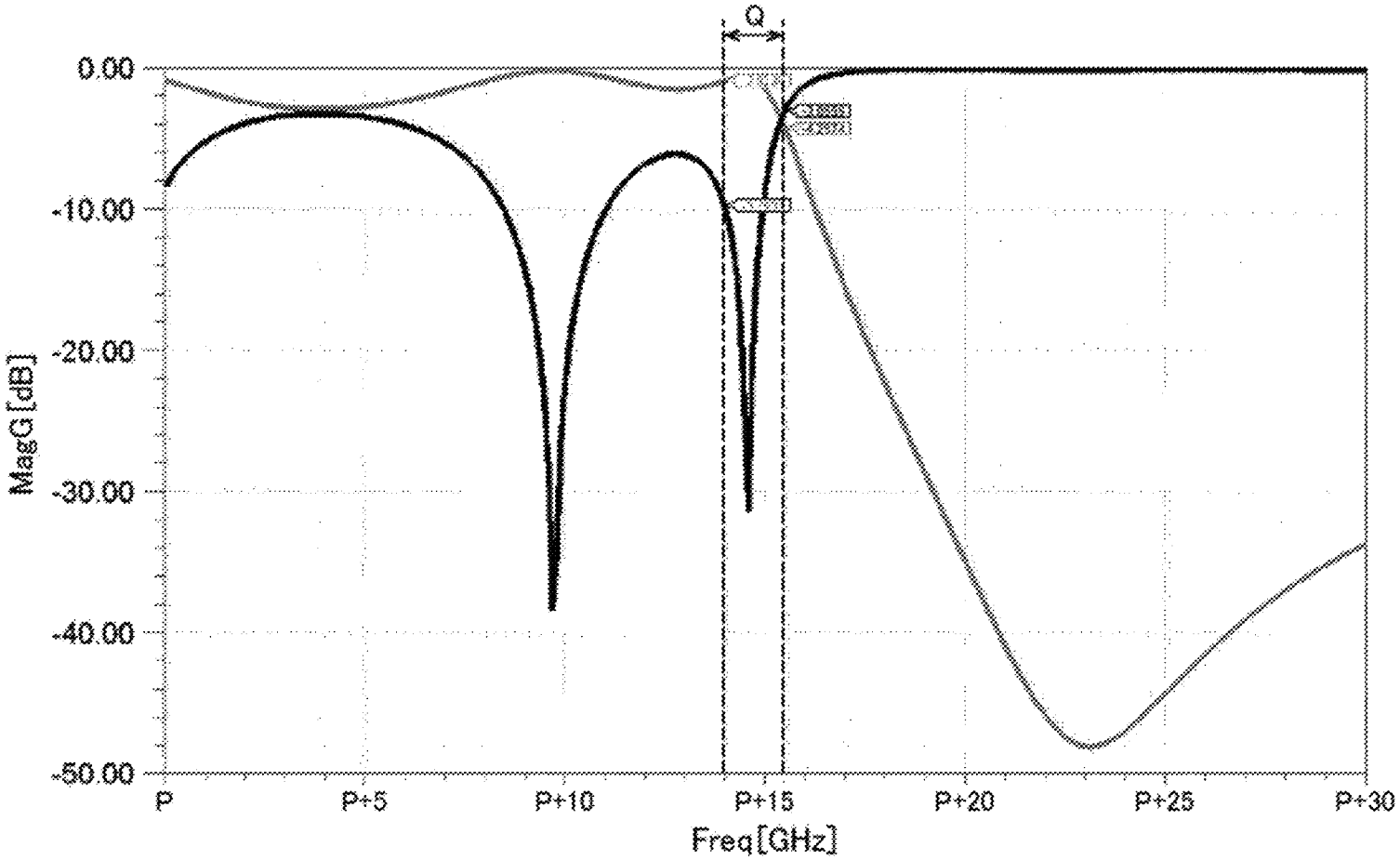
FIG. 18 is a diagram illustrating a simulation result of the three-layer structure.
Figure 19:
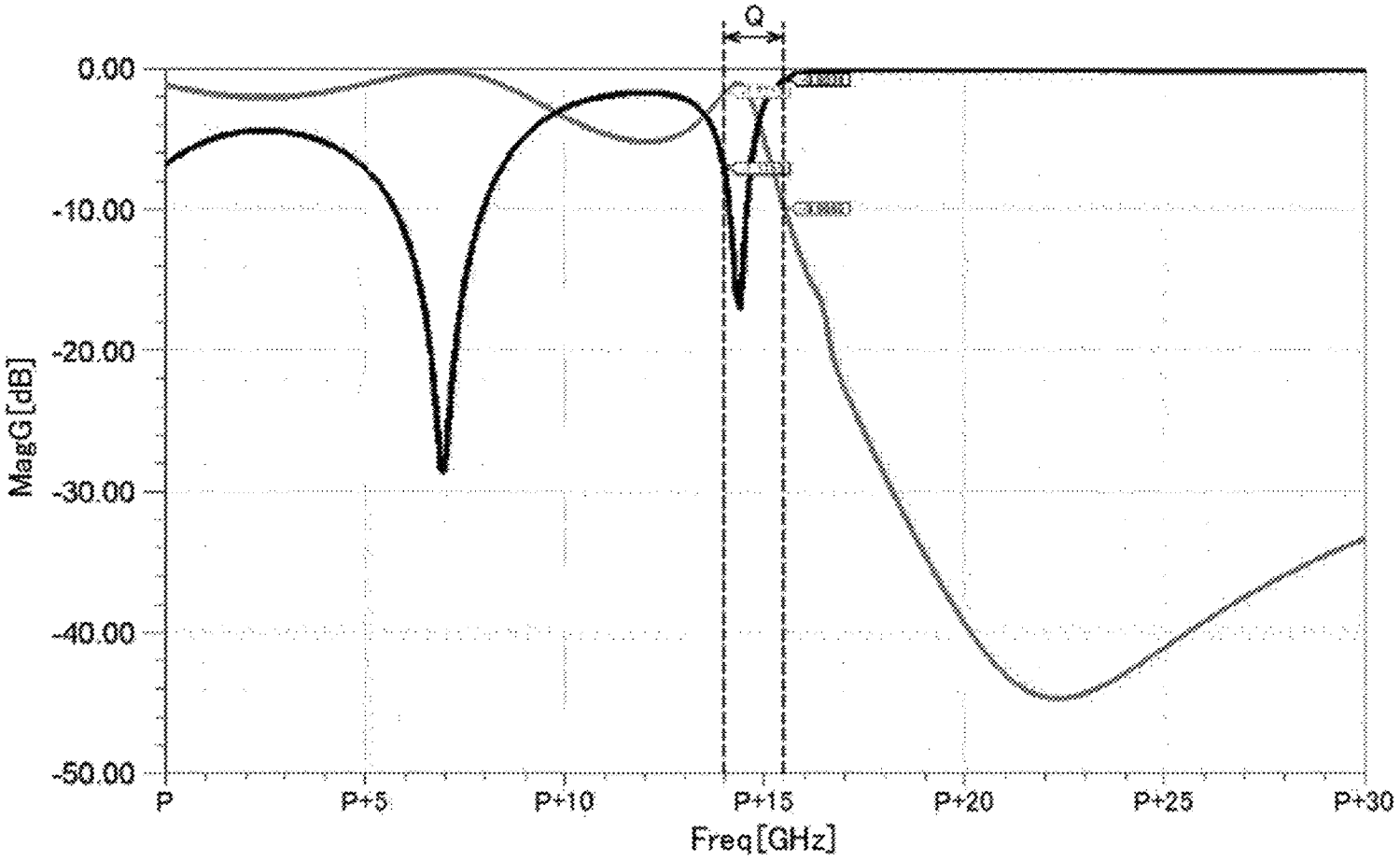
FIG. 19 is a diagram illustrating a simulation result of the three-layer structure.

The difference in characteristics between a three-layer structure and a six-layer structure are presented by use of in FIG. 17 to FIG. 22. FIG. 17 to FIG. 19 illustrate a characteristic of a three-layer structure in which three layers of admittance sheets are laminated. FIG. 17 illustrates data (a simulation result) of arg(G21) between the lower surface and the upper surface of the three-layer structure. The horizontal axis indicates a frequency (GHz) of a transmitted electromagnetic wave. Data in a frequency width of 10 GHz are illustrated in the diagram. A structural parameter (a sheet admittance of each plane) varies by line. Note that 360 degrees (from −180 degrees to 180 degrees) is covered in steps of about 45 degrees.

A steep frequency response exists in a part indicated by a frame W in FIG. 17. In other words, existence of a three-dimensional unit cell exhibiting a steep frequency response is confirmed.

Passing power characteristics [arg(G21) between the lower surface and the upper surface of a structure] of two three-dimensional unit cells exhibiting a steep frequency response are illustrated in FIG. 18 and FIG. 19. Each diagram tells that a bandwidth is remarkably narrow, and a practically required characteristic is not achieved. Further, while P represents an example of a required bandwidth in the diagram, it is observed that an impedance matching characteristic is degraded at the edge of a required bandwidth Q and passing efficiency is significantly reduced.

Figure 20:
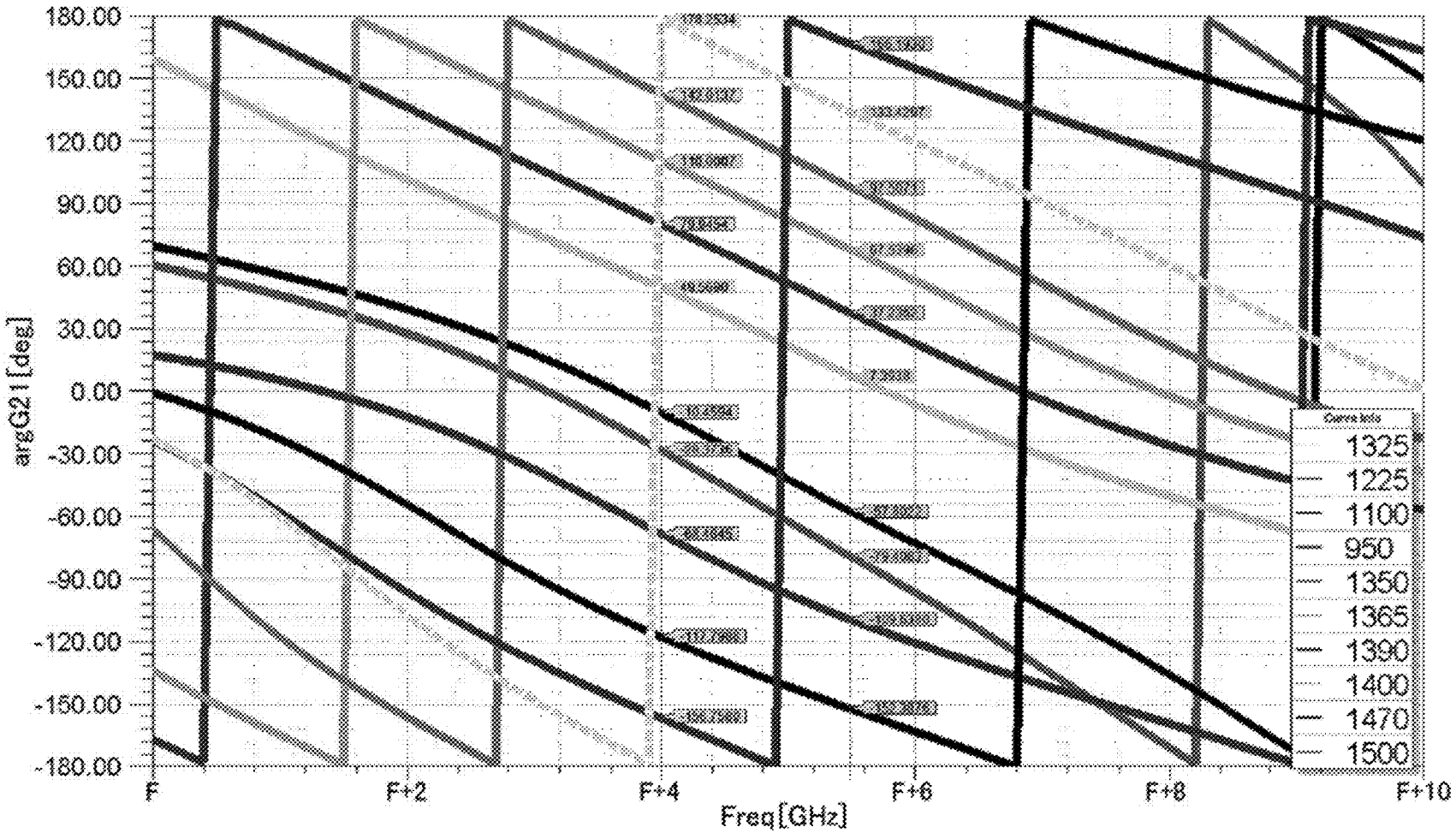
FIG. 20 is a diagram illustrating a simulation result of a six-layer structure.
Figure 21:
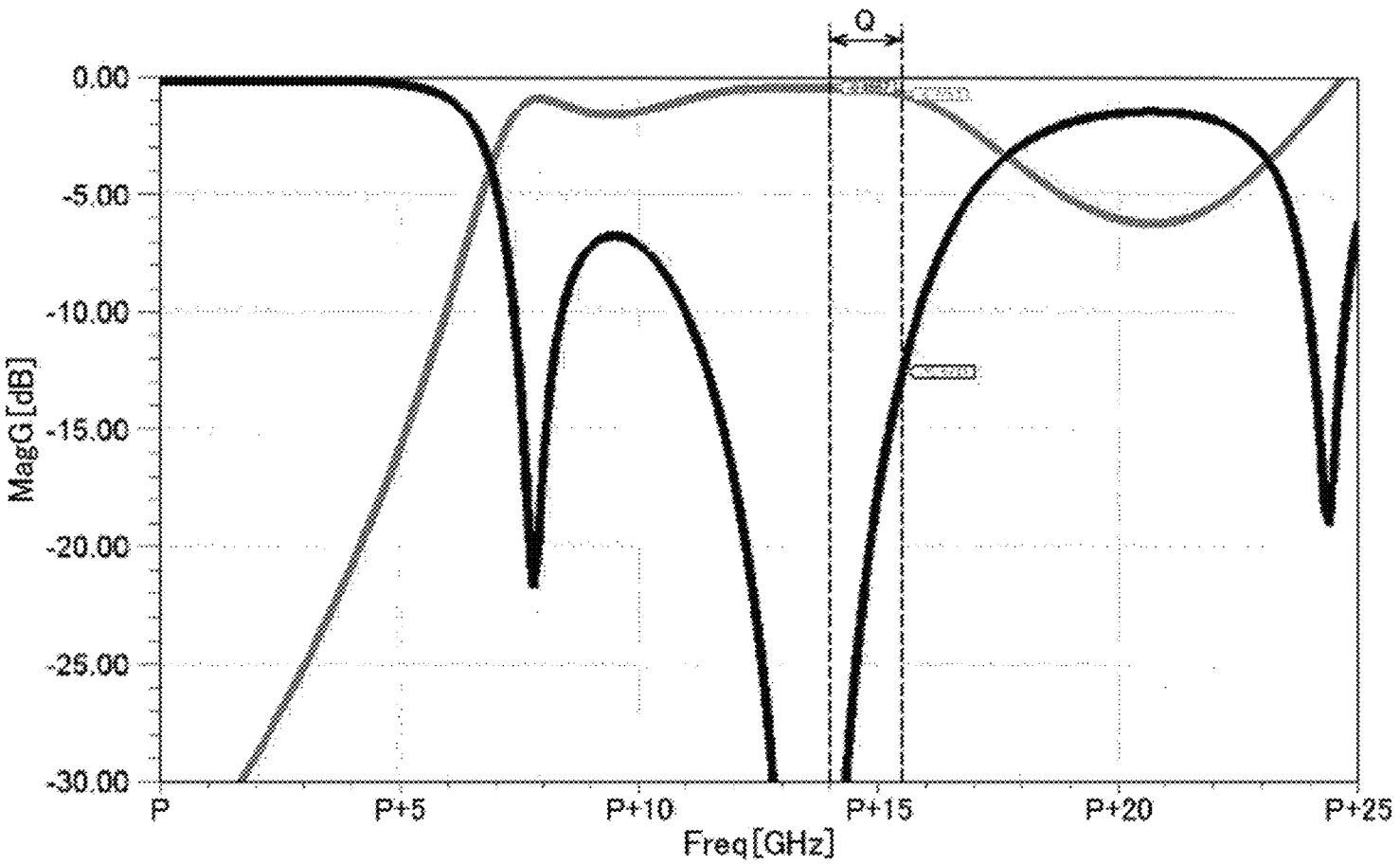
FIG. 21 is a diagram illustrating a simulation result of the six-layer structure.
Figure 22:
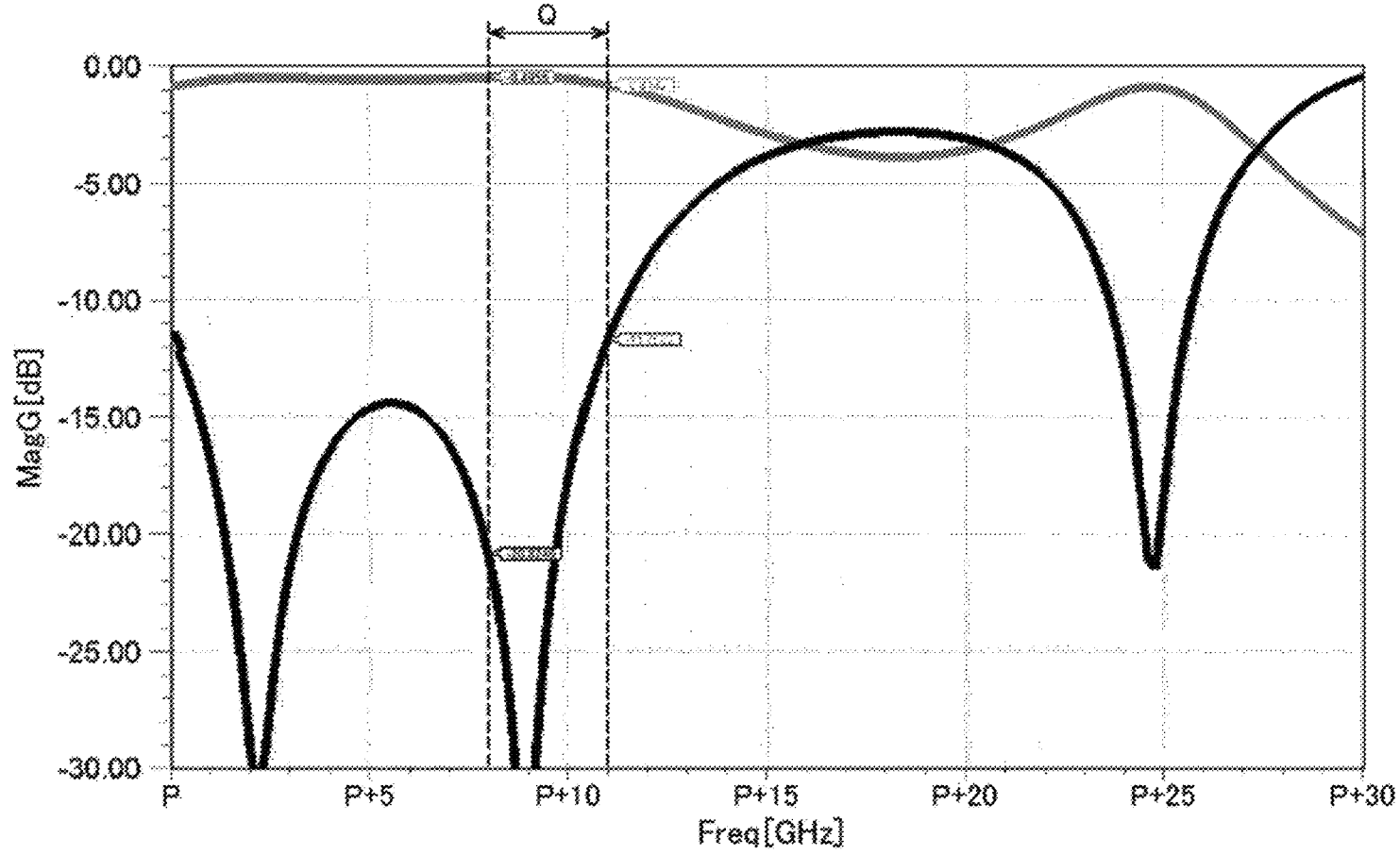
FIG. 22 is a diagram illustrating a simulation result of the six-layer structure.

FIG. 20 to FIG. 22 illustrate a characteristic of a six-layer structure in which six layers of admittance sheets are laminated. FIG. 20 illustrates data (a simulation result) of arg(G21) between the upper surface and the lower surface of the six-layer structure. The six-layer structure has a structure in which a three-layer structure covering 180 degrees (from −180 degrees to 0 degrees) in steps of about 45 degrees and a three-layer structure covering 180 degrees (from 0 degrees to 180 degrees) in steps of about 45 degrees are laminated. Unlike the case of the three-layer structure, no steep frequency response exists in FIG. 20. In other words, no three-dimensional unit cell exhibiting a steep frequency response exists.

Passing power characteristics [arg(G21) between the lower surface and the upper surface of a structure] of three-dimensional unit cells corresponding to the two three-dimensional unit cells exhibiting a steep frequency response in the three-layer structure are illustrated in FIG. 21 and FIG. 22. Each diagram tells that a gentle frequency characteristic and high passing efficiency are achieved throughout the required bandwidth Q. Further, it is also observed that sufficient impedance matching is achieved.

Note that, while an example of causing a three-layer structure to cover a range of 180 degrees and covering a range of 360 degrees with a six-layer structure in which two three-layer structures are laminated has been described, a range covered by a three-layer structure may be decreased and the range of 360 degrees may be covered by laminating a greater number of three-layer structures. For example, a range of 120 degrees may be covered by a three-layer structure, and the range of 360 degrees may be covered by laminating three three-layer structures. However, a greater number of laminated layers causes increase in thickness of the phase control plate the polarization control plate and hinders thinning of a device. The six-layer structure contributes to thinning of a device while achieving a sufficient characteristic as described above.

In a case of a polarization control plate in which two layers of admittance sheets with the same admittance $Y_0$ are laminated at a sufficiently close distance, it is known that equivalent performance can be achieved even when the two layers of admittance sheets are replaced by a single-layer admittance sheet with the admittance $Y_0$. Therefore, equivalent performance can be achieved in a structure ($Y_1/Y_2/Y_3/Y_2/Y_1$) configured by replacing the two layers in the middle in a six-layer structure with the aforementioned symmetric structure ($Y_1/Y_2/Y_3/Y_3/Y_2/Y_1$) with a single layer.

In other words, a polarization control plate including five layers of admittance sheets and four layers of dielectric layers that are alternately laminated can achieve performance equivalent to that of the aforementioned polarization control plate including six layers of admittance sheets and five layers of dielectric layers that are alternately laminated. The same applies to a laminated structure including more layers.

Further, a two-layer structure in which two layers of admittance sheets and a single-layer dielectric layer are laminated may cover a range of 180 degrees, and a four-layer structure in which two two-layer structures are laminated may cover a range of 360 degrees, according to the present example embodiment. In this case, advantageous effects similar to those of the six-layer structure can also be acquired.

Examples of reference embodiments are added below as supplementary notes.

1. A polarization control plate including n layers ($n \geq 4$) of overlapping admittance sheets each of which includes a plurality of plane unit cells, in which
   - an admittance of the plane unit cell in an x direction parallel with a plane in which the plane unit cell extends and an admittance of the plane unit cell in a y direction being orthogonal to the x direction and also being parallel with the plane are different from each other, and
   - an admittance of a first plane unit cell included in an admittance sheet in a layer a ($1 \leq a \leq n$) and an admittance of a second plane unit cell being included in an admittance sheet in a layer b ($1 \leq b \leq n$ and $b \neq a$) and overlapping the first plane unit cell are different from each other.

2. The polarization control plate according to 1, further including
   - a plurality of three-dimensional unit cells each of which is configured with a plurality of the plane unit cells overlapping one another, in which
   - a difference between an admittance of the plane unit cell in a c-th layer ($1 \leq c \leq n$) and an admittance of the plane unit cell in an (n−c+1)-th layer is less than a reference value in at least one of the three-dimensional unit cells.

3. The polarization control plate according to 1 or 2, further including
   - a plurality of three-dimensional unit cells each of which is configured with a plurality of the plane unit cells overlapping one another, in which
   - a metal pattern of the plane unit cell in a c-th layer ($1 \leq c \leq n$) and a metal pattern of the plane unit cell in an (n−c+1)-th layer are identical in at least one of the three-dimensional unit cells.

4. The polarization control plate according to any one of 1 to 3, further including
   - a plurality of three-dimensional unit cells each of which is configured with a plurality of the plane unit cells overlapping one another, in which
   - the three-dimensional unit cell group giving an identical polarization state change to a transmitting electromagnetic wave is linearly arranged, and straight lines of a plurality of the three-dimensional unit cell groups giving polarization state changes different from one another are radially arranged.

5. The polarization control plate according to any one of 1 to 4, in which
   - a polarization state change given to a transmitting electromagnetic wave at a reference point on the polarization control plate varies according to an angle formed between a representative line connecting a representative point on the polarization control plate to an edge of the polarization control plate and a reference line connecting the representative point to the reference point.

6. The polarization control plate according to 5, in which an amount of phase delay given to a linearly polarized electromagnetic wave in a direction of an angle θ/2 is different by 180 degrees from an amount of phase delay given to a linearly polarized electromagnetic wave in a direction of an angle (θ/2+90) degrees, at the reference point on a line forming an angle θ between the representative line and the reference line.

7. The polarization control plate according to 5, in which an amount of phase delay given to a linearly polarized electromagnetic wave in a direction of an angle (θ+45) degrees is different by 90 degrees from an amount of phase delay given to a linearly polarized electromagnetic wave in a direction of an angle (θ+135) degrees, at the reference point positioned to form an angle θ between the representative line and the reference line.

8. The polarization control plate according to any one of 1 to 7, in which admittances of the n layers of admittance sheets are given in such a way that an off-diagonal element of a scattering coefficient formula G below acquired from an equivalent circuit diagram including the n layers of admittance sheets and (n−1) layers of dielectric layers positioned between the admittance sheets is equal to or greater than 0.8

[Math. 8]

SCATTERING COEFFICIENT FORMULA $$G = \begin{pmatrix} \frac{1}{\sqrt{Z_s}} & 0 \\ 0 & \frac{1}{\sqrt{Z_L}} \end{pmatrix} \left[\begin{pmatrix} Z_{11} & Z_{12} \\ Z_{21} & Z_{22} \end{pmatrix} + \begin{pmatrix} Z_S & 0 \\ 0 & Z_L \end{pmatrix}\right]\left[\begin{pmatrix} Z_{11} & Z_{12} \\ Z_{21} & Z_{22} \end{pmatrix} - \begin{pmatrix} Z_S & 0 \\ 0 & Z_L \end{pmatrix}\right]^{-1} \begin{pmatrix} \frac{1}{\sqrt{Z_s}} & 0 \\ 0 & \frac{1}{\sqrt{Z_L}} \end{pmatrix}^{-1}, \quad (3)$$

in which $Z_S$ denotes a normalized impedance determined by an incidence angle of an electromagnetic wave with respect to the polarization control plate and a space impedance of a space where the polarization control plate is positioned, $Z_L$ denotes a normalized impedance determined by an emission angle of an electromagnetic wave with respect to the polarization control plate and the space impedance, and $Z_{11}$ to $Z_{22}$ denote elements of a Z matrix determined by an ABCD matrix of each of the n layers of admittance sheets and an ABCD matrix of each of the (n−1) layers of dielectric layers.

What is claimed is:

1. A polarization control plate comprising n layers (n≥4) of overlapping admittance sheets each of which comprises a plurality of plane unit cells, wherein an admittance of the plane unit cell in an x direction parallel with a plane in which the plane unit cell extends and an admittance of the plane unit cell in a y direction being orthogonal to the x direction and also being parallel with the plane are different from each other, and an admittance of a first plane unit cell included in an admittance sheet in a layer a (1≤a≤n) and an admittance of a second plane unit cell being included in an admittance sheet in a layer b (1≤b≤n and b≠a) and overlapping the first plane unit cell are different from each other.

2. The polarization control plate according to claim 1, further comprising a plurality of three-dimensional unit cells each of which is configured with a plurality of the plane unit cells overlapping one another, wherein a difference between an admittance of the plane unit cell in a c-th layer (1≤c≤n) and an admittance of the plane unit cell in an (n−c+1)-th layer is less than a reference value in at least one of the three-dimensional unit cells.

3. The polarization control plate according to claim 1, further comprising a plurality of three-dimensional unit cells each of which is configured with a plurality of the plane unit cells overlapping one another, wherein a metal pattern of the plane unit cell in a c-th layer (1≤c≤n) and a metal pattern of the plane unit cell in an (n−c+1)-th layer are identical in at least one of the three-dimensional unit cells.

4. The polarization control plate according to claim 1, further comprising a plurality of three-dimensional unit cells each of which is configured with a plurality of the plane unit cells overlapping one another, wherein the three-dimensional unit cell group giving an identical polarization state change to a transmitting electromagnetic wave is linearly arranged, and straight lines of a plurality of the three-dimensional unit cell groups giving polarization state changes different from one another are radially arranged.

5. The polarization control plate according to claim 1, wherein a polarization state change given to a transmitting electromagnetic wave at a reference point on the polarization control plate varies according to an angle formed between a representative line connecting a representative point on the polarization control plate to an edge of the polarization control plate and a reference line connecting the representative point to the reference point.

6. The polarization control plate according to claim 5, wherein an amount of phase delay given to a linearly polarized electromagnetic wave in a direction of an angle θ/2 is different by 180 degrees from an amount of phase delay given to a linearly polarized electromagnetic wave in a direction of an angle (θ/2+90) degrees, at the reference point on a line forming an angle θ between the representative line and the reference line.

7. The polarization control plate according to claim 5, wherein an amount of phase delay given to a linearly polarized electromagnetic wave in a direction of an angle (θ+45) degrees is different by 90 degrees from an amount of phase delay given to a linearly polarized electromagnetic wave in a direction of an angle (θ+135) degrees, at the reference point positioned to form an angle θ between the representative line and the reference line.

8. The polarization control plate according to claim 1, wherein admittances of the n layers of admittance sheets are given in such a way that an off-diagonal element of a scattering coefficient formula G below acquired from an equivalent circuit diagram including the n layers of admittance sheets and (n−1) layers of dielectric layers positioned between the admittance sheets is equal to or greater than 0.8

[Math. 1]

SCATTERING COEFFICIENT FORMULA $$G = \begin{pmatrix} \frac{1}{\sqrt{Z_s}} & 0 \\ 0 & \frac{1}{\sqrt{Z_L}} \end{pmatrix} \left[\begin{pmatrix} Z_{11} & Z_{12} \\ Z_{21} & Z_{22} \end{pmatrix} + \begin{pmatrix} Z_S & 0 \\ 0 & Z_L \end{pmatrix}\right]\left[\begin{pmatrix} Z_{11} & Z_{12} \\ Z_{21} & Z_{22} \end{pmatrix} - \begin{pmatrix} Z_S & 0 \\ 0 & Z_L \end{pmatrix}\right]^{-1} \begin{pmatrix} \frac{1}{\sqrt{Z_s}} & 0 \\ 0 & \frac{1}{\sqrt{Z_L}} \end{pmatrix}^{-1}, \quad (3)$$

wherein $Z_5$ denotes a normalized impedance determined by an incidence angle of an electromagnetic wave with respect to the polarization control plate and a space impedance of a space where the polarization control plate is positioned, $Z_L$ denotes a normalized impedance determined by an emission angle of an electromagnetic wave with respect to the polarization control plate and the space impedance, and $Z_{11}$ to $Z_{22}$ denote elements of a Z matrix determined by an ABCD matrix of each of the n layers of admittance sheets and an ABCD matrix of each of the (n−1) layers of dielectric layers.

* * * * *